US010730107B2

(12) United States Patent
Atkins et al.

(10) Patent No.: US 10,730,107 B2
(45) Date of Patent: Aug. 4, 2020

(54) MOLD TRANSFER ASSEMBLIES AND METHODS OF USE

(71) Applicant: Halliburton Energy Services, Inc., Houston, TX (US)

(72) Inventors: William Brian Atkins, Houston, TX (US); Clayton Arthur Ownby, Houston, TX (US); Michael Clark, Tomball, TX (US); Grant O. Cook, III, Spring, TX (US); Garrett T. Olson, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/281,968

(22) Filed: Feb. 21, 2019

(65) Prior Publication Data

US 2019/0184459 A1 Jun. 20, 2019

Related U.S. Application Data

(62) Division of application No. 14/787,133, filed as application No. PCT/US2015/013294 on Jan. 28, 2015, now Pat. No. 10,252,329.

(51) Int. Cl.
*B22D 27/04* (2006.01)
*B22D 19/06* (2006.01)
(Continued)

(52) U.S. Cl.
CPC ..... *B22D 27/045* (2013.01); *B22D 19/06* (2013.01); *B22D 33/005* (2013.01); *F27D 15/02* (2013.01);
(Continued)

(58) Field of Classification Search
CPC ..... B22D 33/005; B22D 30/00; B22D 47/00; B22D 47/02; F27D 15/02
See application file for complete search history.

(56) References Cited

U.S. PATENT DOCUMENTS 3,860,104 A 1/1975 Strauss
6,220,117 B1 4/2001 Butcher
(Continued)

FOREIGN PATENT DOCUMENTS

GB 9919051 2/2000
GB 2343194 3/2000
(Continued)

OTHER PUBLICATIONS

ISRWO International Search Report and Written Opinion for PCT/US2015/013294 dated Oct. 8, 2015.
(Continued)

*Primary Examiner* — Kevin E Yoon
*Assistant Examiner* — Jacky Yuen
(74) *Attorney, Agent, or Firm* — Thomas Rooney; C. Tumey Law Group PLLC

(57) ABSTRACT

A mold transfer assembly includes a transfer housing providing an interior defined by one or more sidewalls and a top. The transfer housing is sized to receive and encapsulate a mold as the mold is moved between a furnace and a thermal heat sink. An arm is coupled to the transfer housing to move the transfer housing and the mold encapsulated within the transfer housing between the furnace and a thermal heat sink. The transfer housing exhibits one or more thermal properties to control a thermal profile of the mold.

16 Claims, 11 Drawing Sheets

(51) Int. Cl.

| | |
|---|---|
| ***B22D 33/00*** | (2006.01) |
| ***F27D 15/02*** | (2006.01) |
| *B22F 7/06* | (2006.01) |
| *B22F 3/26* | (2006.01) |
| *C22C 1/10* | (2006.01) |
| *C22C 29/06* | (2006.01) |
| *B22F 5/00* | (2006.01) |

(52) U.S. Cl.
CPC ..... *B22F 3/26* (2013.01); *B22F 2005/001* (2013.01); *B22F 2007/066* (2013.01); *B22F 2999/00* (2013.01); *C22C 1/1068* (2013.01); *C22C 29/06* (2013.01)

(56) References Cited

U.S. PATENT DOCUMENTS

| | | | |
|---|---|---|---|
| 6,932,145 | B2 | 8/2005 | Frasier et al. |
| 6,932,938 | B2 | 8/2005 | Norville et al. |
| 7,343,960 | B1 | 3/2008 | Frasier et al. |
| 7,377,305 | B2 | 5/2008 | Frasier et al. |
| 7,418,993 | B2 | 9/2008 | Frasier et al. |
| 7,779,890 | B2 | 8/2010 | Frasier et al. |
| 7,824,494 | B2 | 11/2010 | Frasier et al. |
| 8,082,976 | B2 | 12/2011 | Frasier et al. |
| 8,087,446 | B2 | 1/2012 | Frasier et al. |
| 8,181,692 | B2 | 5/2012 | Frasier et al. |
| 8,550,144 | B2 | 10/2013 | Frasier et al. |
| 2003/0232105 | A1 | 12/2003 | Nightingale et al. |
| 2013/0180692 | A1 | 7/2013 | Gomez et al. |
| 2013/0180693 | A1 | 7/2013 | Gomez et al. |
| 2014/0261904 | A1 | 9/2014 | Crafton et al. |

FOREIGN PATENT DOCUMENTS

| | | |
|---|---|---|
| GB | 0123704 | 11/2001 |
| GB | 2364529 | 1/2002 |
| KR | 20020078834 | 10/2002 |
| WO | 2008157704 | 12/2008 |
| WO | 2014143001 | 9/2014 |

OTHER PUBLICATIONS

Office Action dated Feb. 9, 2017 for U.S. Appl. No. 14/787,133.
Office Action dated Oct. 4, 2018 for U.S. Appl. No. 14/787,133.
Notice of Allowance dated Nov. 30, 2018 for U.S. Appl. No. 14/787,133.
Final Office Action dated Oct. 6, 2017 for U.S. Appl. No. 14/787,133.

MOLD TRANSFER ASSEMBLIES AND METHODS OF USE

BACKGROUND

A variety of downhole tools are used in the exploration and production of hydrocarbons. Examples of such downhole tools include cutting tools, such as drill bits, reamers, stabilizers, and coring bits; drilling tools, such as rotary steerable devices and mud motors; and other downhole tools, such as window mills, packers, tool joints, and other wear-prone tools. Rotary drill bits are often used to drill wellbores. One type of rotary drill bit is a fixed-cutter drill bit that has a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body.

Matrix drill bits may be manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement materials within interior portions of the mold cavity. A preformed bit blank (or mandrel) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace may maintain this desired temperature to the point that the infiltration process is deemed complete, such as when a specific location in the bit reaches a certain temperature. Once the designated process time or temperature has been reached, the mold containing the infiltrated matrix bit is removed from the furnace and placed on a cooling plate where an insulation enclosure or "hot hat" is typically lowered around the mold. The insulation enclosure serves to reduce the rate of heat loss from the top and sides of the mold while heat is drawn from the bottom of the mold through the cooling plate. This controlled cooling of the mold and the infiltrated matrix bit contained therein can facilitate axial solidification dominating radial solidification, which is loosely termed directional solidification.

As the mold is removed from the furnace and moved to the cooling plate, however, and before the insulation enclosure is properly positioned over the mold, the mold loses a large amount of heat to its surrounding environment via heat transfer (e.g., radiation and/or convection in all directions). This heat loss continues to a large extent until the insulation enclosure is positioned about the mold. Accordingly, during the transfer process from the furnace to the cooling plate, directional solidification of the molten materials may not occur, which could result in voids forming within the bit body unless the molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing assuming they cannot be remedied. Every effort is made to detect these defects and reject any defective drill bit components during manufacturing to help ensure that the drill bits used in a job at a well site will not prematurely fail and to minimize any risk of possible damage to the well.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole tool manufacturing and, more particularly, to mold transfer assemblies used to remove a mold from a furnace and transfer the mold to a cooling plate for controlled cooling.

The embodiments described herein improve directional solidification of infiltrated metal matrix composite tools, such as drill bits, by controlling and otherwise regulating thermal energy transfer from a mold during transfer between a furnace and a thermal heat sink. More specifically, the present disclosure describes embodiments of mold transfer assemblies designed to substantially encapsulate a mold following an infiltration process and move the mold from the furnace to a thermal heat sink for controlled cooling. The mold transfer assemblies may each include a transfer housing sized to receive and enclose the mold for the transfer. The thermal housing may exhibit one or more thermal properties used to control the thermal profile of the mold as it is moved between the furnace and the thermal heat sink.

In some cases, the thermal housing may be configured to insulate the mold during the transfer. In other cases, however, the thermal housing may be configured to passively or actively impart thermal energy to the mold and thereby control the release of thermal energy from the mold. As will be appreciated, the embodiments described herein may prove advantageous in mitigating the radiative and convective heat losses from the mold to the environment during the transfer process, and thereby improving directional solidification of the molten contents within the mold. Among other things, this may improve quality and reduce the rejection rate of drill bit components due to defects during manufacturing.

Figure 1:
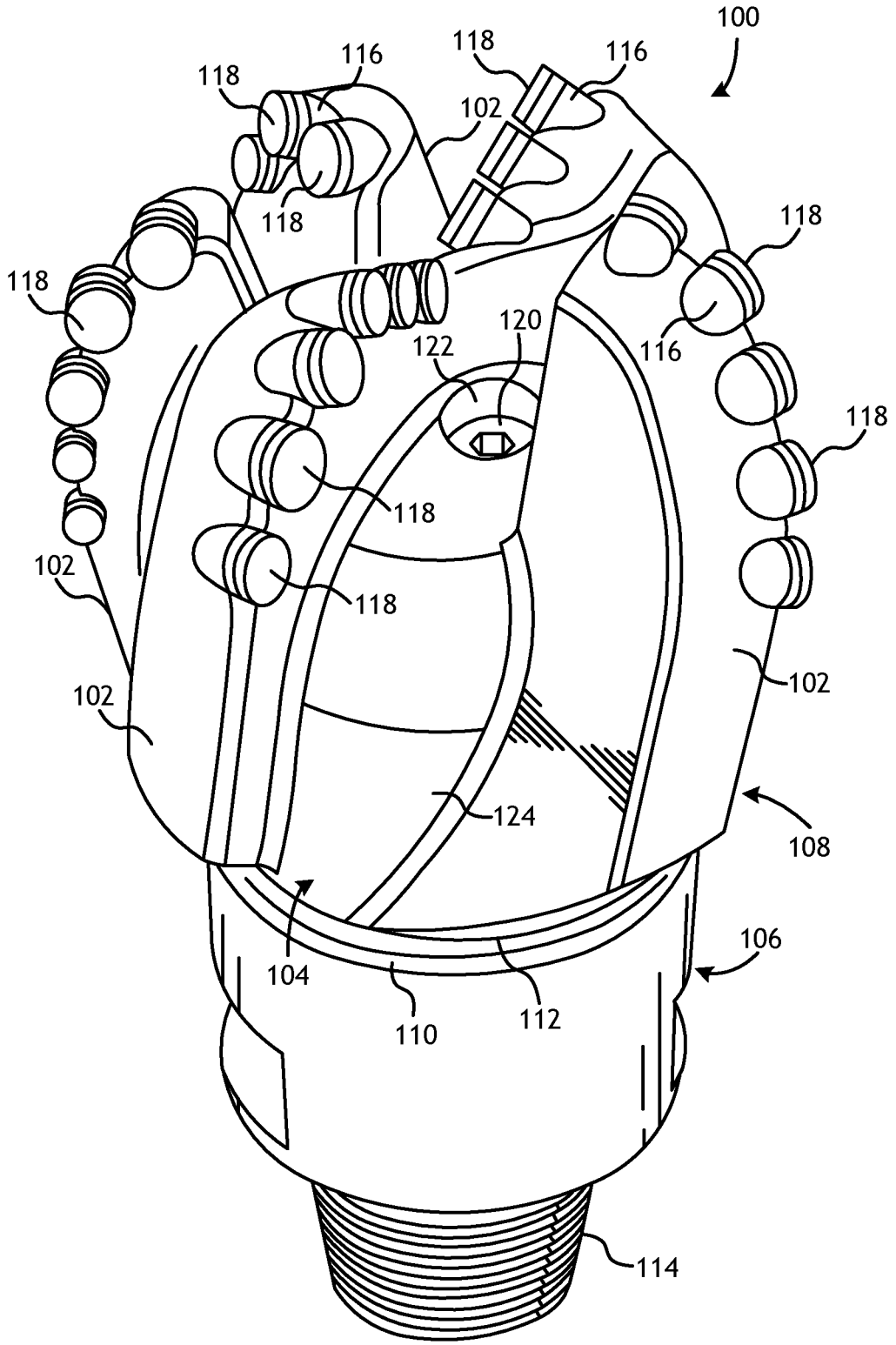
FIG. 1 is a perspective view of an exemplary fixed-cutter drill bit that may be fabricated in accordance with the principles of the present disclosure.

FIG. 1 illustrates a perspective view of an example fixed-cutter drill bit 100 that may be fabricated in accordance with the principles of the present disclosure. It should be noted that, while FIG. 1 depicts a fixed-cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, brazing, or other fusion methods, such as submerged arc or metal inert gas arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
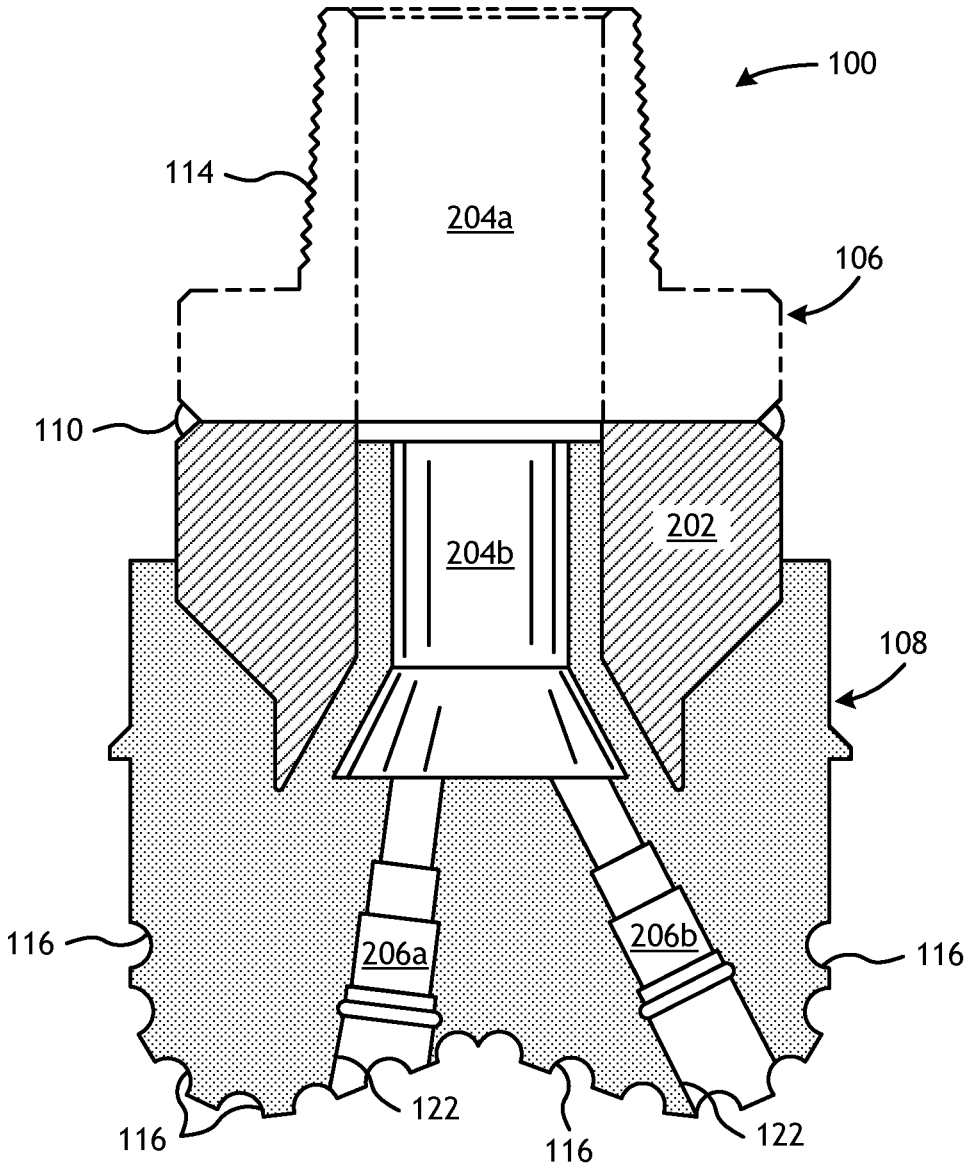
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway (shown as two flow passageways 206*a* and 206*b*) may extend from the fluid cavity 204*b* to exterior portions of the bit body 108. The nozzle openings 122 may be defined at the ends of the flow passageways 206*a* and 206*b* at the exterior portions of the bit body 108. The pockets 116 are formed in the bit body 108 and are shaped or otherwise configured to receive the cutting elements 118 (FIG. 1).

Figure 3A:
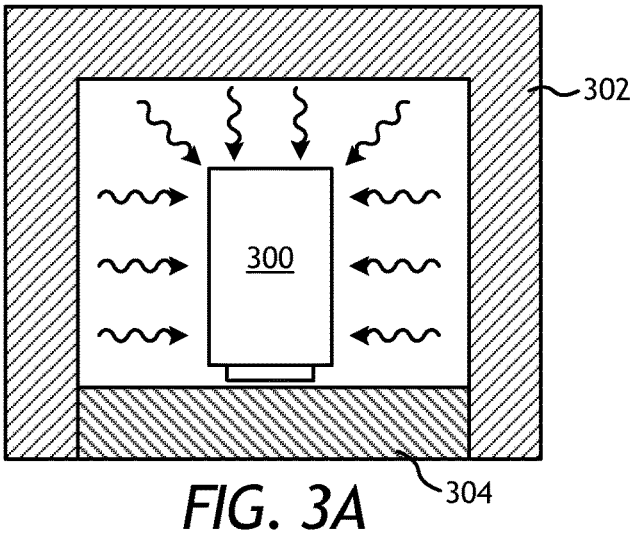
FIGS. 3A-3E are schematic diagrams that sequentially illustrate an example system and method for fabricating a drill bit.
Figure 3B:
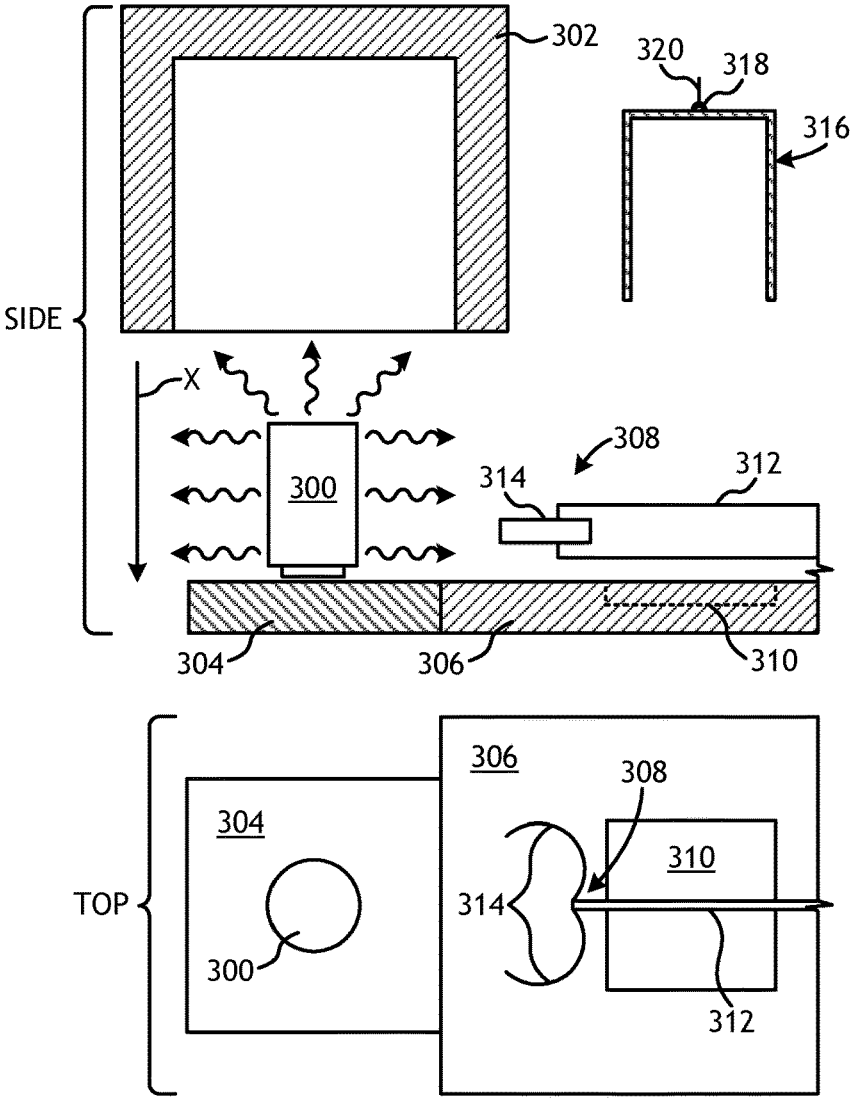

FIGS. 3A-3E are schematic diagrams that sequentially illustrate an example system and method for fabricating a drill bit, such as the drill bit 100 of FIG. 1. FIGS. 3B-3E each show corresponding partial cross-sectional side and top views of the system and method at different points in the process. A mold 300 is depicted in each drawing and may contain the necessary materials used to form the drill bit 100 (or any other metal matrix composite). In FIG. 3A, the mold 300 is depicted as being positioned within a furnace 302 and, more particularly, on a furnace floor 304 arranged within the furnace 302. The temperature of the mold 300 and its contents are elevated within the furnace 302 until binder materials deposited within the mold 300 liquefy and are able to infiltrate matrix reinforcement materials also deposited within the mold 300.

Once a specific location in the mold 300 reaches a certain temperature, or the mold 300 is otherwise maintained at a particular temperature for a predetermined amount of time within the furnace 302, the mold 300 may then be removed from the furnace 302. This may be accomplished by first exposing the mold 300, such as by retracting the furnace floor 304 downward in the direction X with respect to the remaining portions of the furnace 302 until the furnace floor 304 is level with a transfer table 306. In other embodiments, however, the transfer table 306 may initially be level with the furnace floor 304 and mold 300 may be exposed by raising the remaining portions of the furnace 302 upward (i.e., opposite the direction X) with respect to the furnace floor 304. Once exposed to the surrounding environment, the mold 300 immediately begins to lose heat by radiating thermal energy to its surroundings while heat is also convected away by cooler air outside the furnace 302.

Figure 3D:
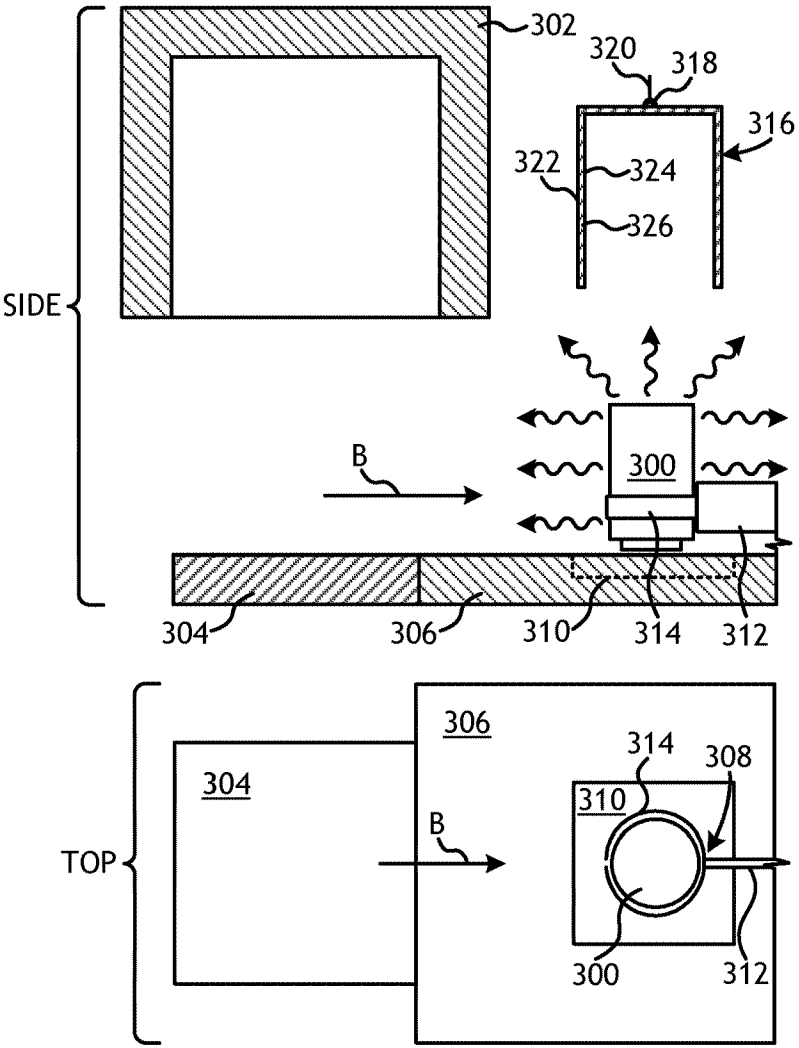
Figure 3C:
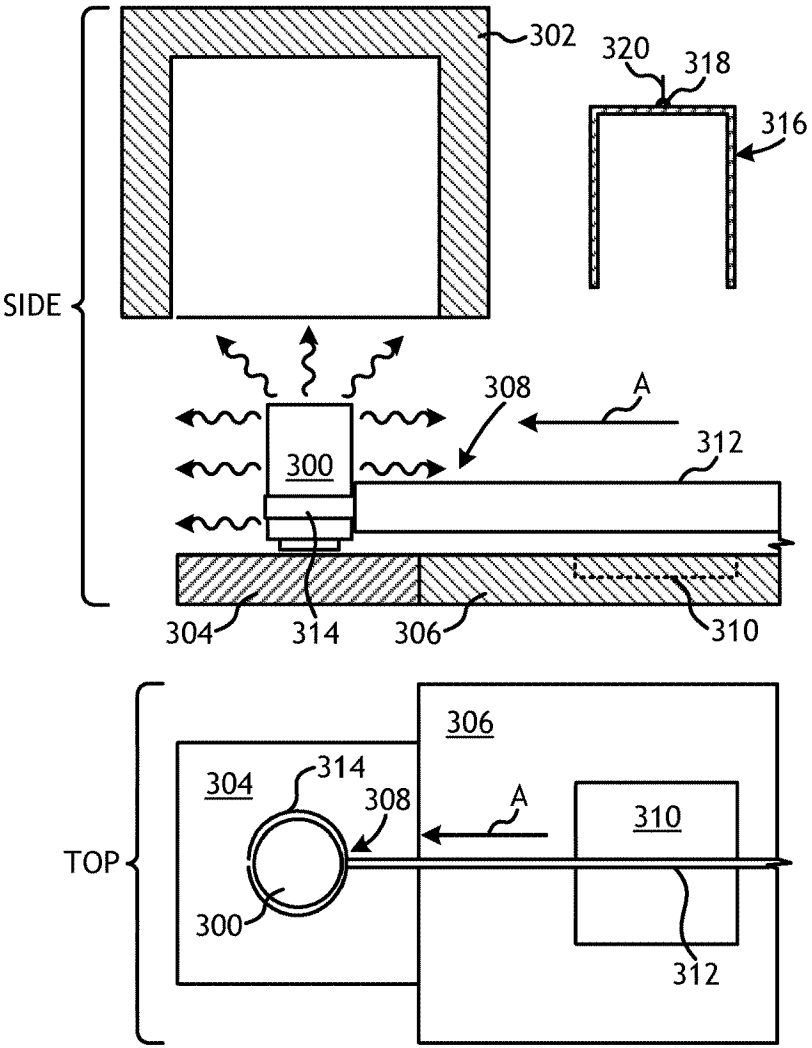
Figure 3E:
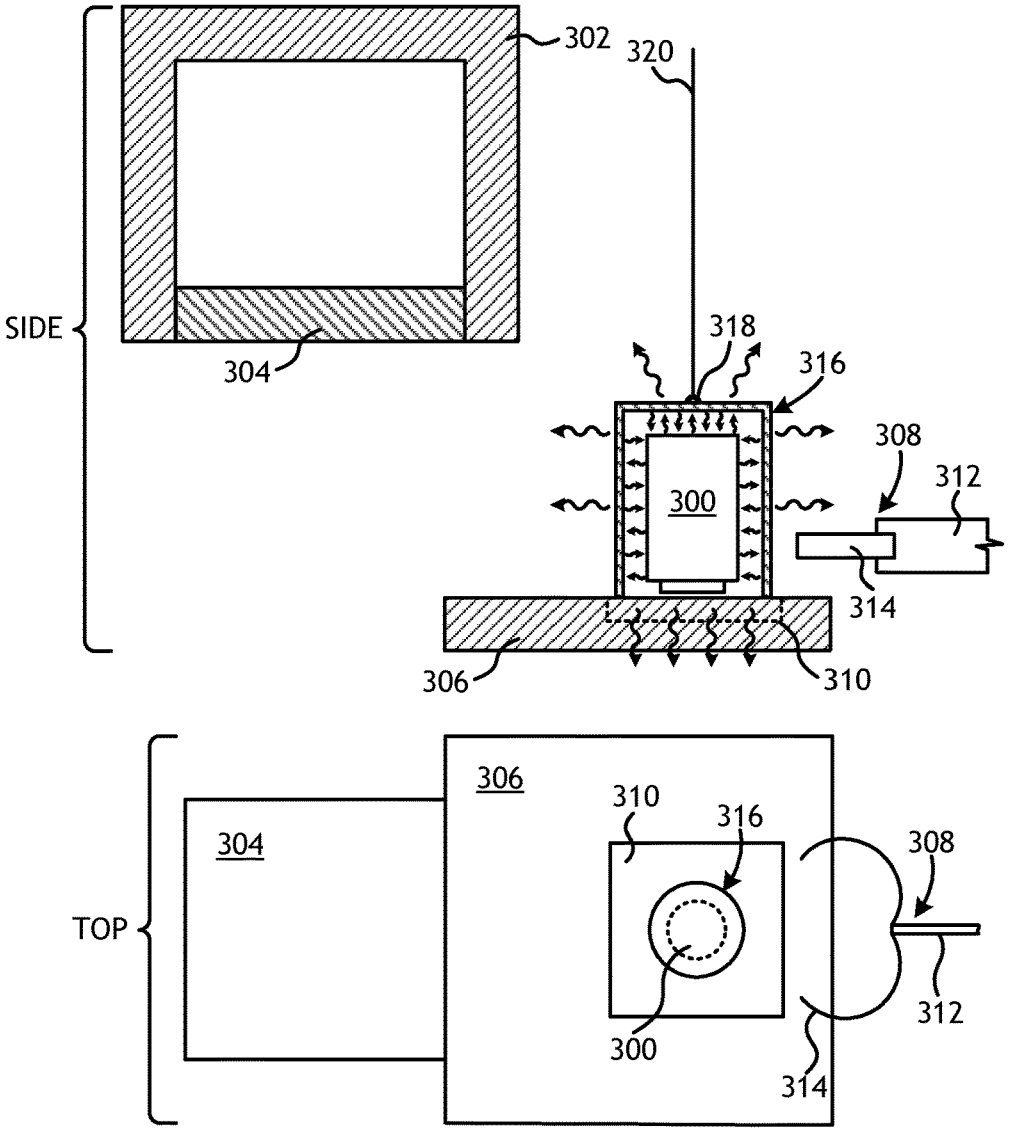

A mold transfer assembly 308 may then be used to move or transfer the mold 300 from the furnace floor 304 to a thermal heat sink 310 associated with the transfer table 306. In some embodiments, as illustrated, the mold transfer assembly 308 may include an arm 312 and a pair of arcuate tongs 314 attached to an end of the arm 312. As shown in FIG. 3C, the mold transfer assembly 308 may be moved toward the mold 300 in a first direction A and the tongs 314 may be actuated to grasp onto the mold 300 about its exterior. Once the mold 300 is secured by the tongs 314, the mold transfer assembly 308 may then be moved in a second direction B towards its final resting place on the thermal heat sink 310, as shown in FIG. 3D. The furnace floor 304 may be retracted back into place within the furnace 302 when the mold 300 moves off, as shown in FIG. 3E. Once properly placed on the thermal heat sink 310, the mold transfer assembly 308 may detach from the mold 300 and retract to allow the insulation enclosure 316 to be completely lowered. In the illustrated embodiment, for instance, the tongs 314 may be actuated to expand and thereby release the mold 300, and the arm 312 and the tongs 314 may then be retracted from the mold 300.

During movement from the furnace 302 to the thermal heat sink 310, radiative and convective heat losses from the mold 300 to the environment continue until an insulation enclosure 316 is lowered or otherwise placed around the mold 300, as shown in FIG. 3E. The insulation enclosure 316 may be a rigid shell or structure used to insulate the mold 300 and thereby slow the cooling process. In some cases, the insulation enclosure 316 may include a hook 318 attached to a top surface thereof. The hook 318 may provide an attachment location, such as for a lifting member, whereby the insulation enclosure 316 may be grasped and/or otherwise attached to for transport. For instance, a chain or wire 320 may be coupled to the hook 318 to lift and move the insulation enclosure 316. In other cases, a mandrel or other type of manipulator (not shown) may grasp onto the hook 318 to move the insulation enclosure 316 to a desired location.

With reference to FIG. 3D, the insulation enclosure 316 may include a frame that includes at least one of an outer frame 322 and an inner frame 324, and insulation material 326 may be arranged between the outer and inner frames 322, 324. In some embodiments, both the outer frame 322 and the inner frame 324 may be made of rolled steel and shaped (i.e., bent, welded, etc.) into the general shape, design, and/or configuration of the insulation enclosure 316. In other embodiments, the inner frame 324 may be a metal wire mesh that holds the insulation material 326 between the outer frame 322 and the inner frame 324. The insulation material 326 may be selected from a variety of insulative materials, such as those discussed herein. In at least one embodiment, the insulation material 326 may be a ceramic fiber blanket, such as INSWOOL● or the like.

As depicted in FIG. 3E, the insulation enclosure 316 may enclose the mold 300 such that thermal energy radiating from the mold 300 is dramatically reduced from the top and sides of the mold 300 and is instead directed substantially downward and otherwise toward/into the thermal heat sink 310 or back towards the mold 300. In the illustrated embodiment, the thermal heat sink 310 is a cooling or quench plate designed to circulate a fluid (e.g., water) at a reduced temperature relative to the mold 300 (e.g., at or near ambient) to draw thermal energy from the mold 300 and into the circulating fluid, and thereby reduce the temperature of the mold 300. In other embodiments, however, the thermal heat sink 310 may be any type of cooling device or heat exchanger configured to encourage heat transfer from the bottom of the mold 300 to the thermal heat sink 310. In yet other embodiments, the thermal heat sink 310 may be any stable or rigid surface that may support the mold 300, and preferably having a high thermal capacity, such as a concrete slab or flooring.

Once the insulation enclosure 316 is positioned over the mold 300 and the thermal heat sink 310 is operational, the majority of the thermal energy is transferred away from the mold 300 through the bottom of the mold 300 and into the thermal heat sink 310. This controlled cooling of the mold 300 and its contents allows an operator (or automated control system) to regulate or control the thermal profile of the mold 300 to a certain extent and may result in directional solidification of the molten contents within the mold 300, where axial solidification of the molten contents dominates radial solidification. Within the mold 300, the face of the drill bit (i.e., the end of the drill bit that includes the cutters) may be positioned at the bottom of the mold 300 and otherwise adjacent the thermal heat sink 310 while the shank 106 (FIG. 1) may be positioned adjacent the top of the mold 300. As a result, the drill bit 100 (FIGS. 1 and 2) may be cooled axially upward, from the cutting elements 118 (FIG. 1) toward the shank 106 (FIG. 1).

Such directional solidification (from the bottom up) may prove advantageous in reducing the occurrence of voids due to shrinkage porosity, cracks at the interface between the metal blank 202 and the molten materials, and nozzle cracks. However, the extent of this directional solidification might not be sufficient to produce required thermal profiles, and, therefore, resulting properties in the infiltrated drill bit, due in part to the radiation and/or convection losses from the mold 300 during the transfer process. This is especially true of materials that have high thermal conductivities and emissivities, such as graphite. Infrared temperature measurements demonstrate an appreciable drop in surface temperatures on the order of hundreds of degrees Fahrenheit during the time required by the transfer process (e.g., 30-90 seconds). According to the present disclosure, the mold transfer assemblies described herein may be configured to encapsulate or substantially encapsulate the mold 300 within a transfer housing sized to receive the mold 300. As used herein, the term "encapsulate" refers to enclosing the mold 300 entirely or at least partially within a transfer housing, where the transfer housing at least surrounds the sides and top of the mold 300. The transfer housing may exhibit one or more thermal properties used to control the thermal profile of the mold 300 as it is moved between the furnace 302 and the thermal heat sink 310. For instance, the transfer housing may insulate the mold 300 and/or otherwise control the release of thermal energy from the mold 300. As will be appreciated, the transfer housing may prove advantageous in mitigating the radiative and convective heat losses from the mold 300 to the environment during the transfer process, and thereby improving directional solidification of the molten contents within the mold 300.

Referring now to FIGS. 4A-4E, illustrated are schematic diagrams that sequentially illustrate another example system and method for fabricating a drill bit, such as the drill bit 100 of FIG. 1, or any other metal matrix composite structure, according to one or more embodiments of the present disclosure. The system and method shown in FIGS. 4A-4E may be similar in some respects to the system and method depicted in FIGS. 3A-3E and therefore may be best understood with reference thereto, where like numerals correspond to like elements or components. Similar to FIGS. 3B-3E, FIGS. 4B-4E each show corresponding partial cross-sectional side views and top views of the system and method at different points in the process.

Figure 4A:
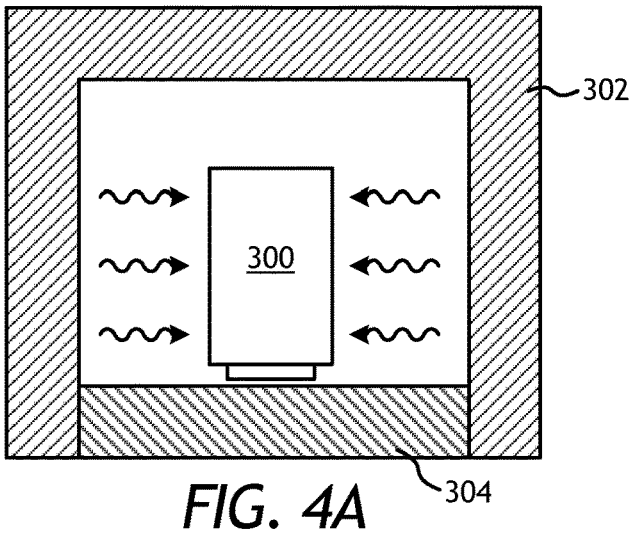
FIGS. 4A-4E are schematic diagrams that sequentially illustrate another example system and method for fabricating a drill bit.

In FIG. 4A, the mold 300 is depicted as being positioned within the furnace 302 on the furnace floor 304, and may be removed from the furnace 302 once the mold 300 is sufficiently heated. In at least one embodiment, as described above, this may be accomplished by retracting the furnace floor 304 downward in the direction X with respect to the remaining portions of the furnace 302 until the furnace floor 304 is level with a transfer table 306 and thereby exposing the mold 300. In other embodiments, however, the transfer table 306 may already be level with the furnace floor 304, which may remain stationary while the remaining portions of the furnace 302 are raised upward (i.e., opposite the direction X) with respect to the furnace floor 304 to expose the mold 300. In yet other embodiments, the furnace floor 304 may comprise a conveyor-type moving surface that transports the mold 300 through an elongate furnace structure (not shown).

A mold transfer assembly 402 may then be used to move and otherwise transfer the mold 300 from the furnace floor 304 to the thermal heat sink 310. Operation of the mold transfer assembly 402 may be manual or automated, without departing from the scope of the disclosure. Similar to the mold transfer assembly 308 of FIGS. 3B-3E, the mold transfer assembly 402 may include an arm 404. Unlike the mold transfer assembly 308 of FIGS. 3B-3E, however, the mold transfer assembly 402 may include a transfer housing 406 coupled to an end of the arm 404. The transfer housing 406 may be configured to receive and enclose the mold 300 for transfer between the furnace floor 304 and the thermal heat sink 310. To accomplish this, the transfer housing 406 may exhibit various designs and/or configurations that allow the transfer housing 406 to substantially encapsulate the mold 300.

Figure 4C:
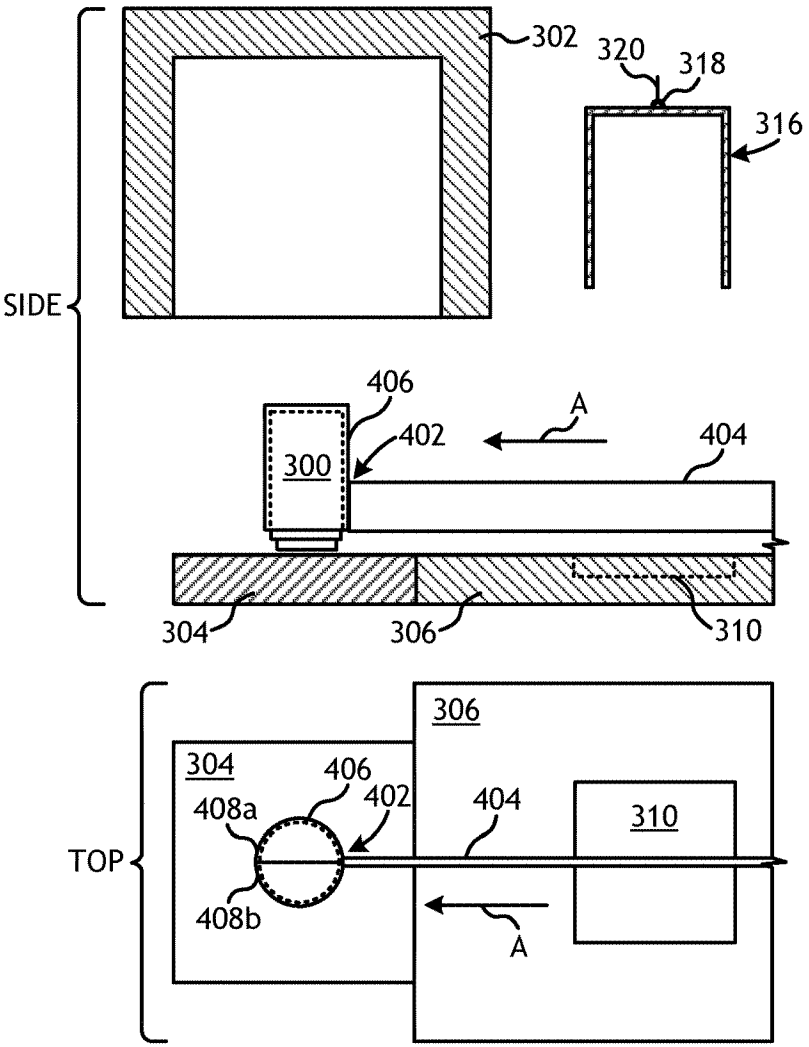
Figure 4B:
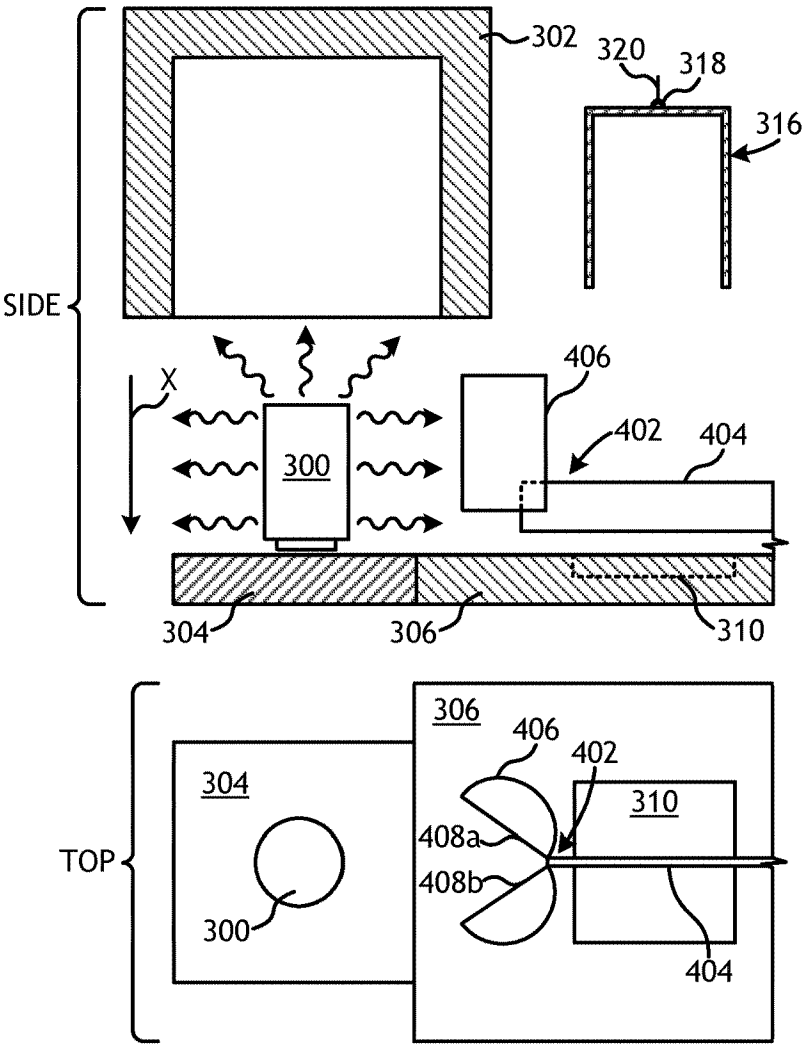

As shown in FIG. 4B, the transfer housing 406 may, in at least one embodiment, comprise a clam-shell design and otherwise include an open-ended cylinder cut into two halves, shown as a first half-cylinder 408*a* and a second half-cylinder 408*b*. The first and second cylinders 408*a,b* may provide sidewalls and a top for the transfer housing 406. In some embodiments, the top may be cooperatively provided by each cylinder 408*a,b*, but may alternatively be coupled to one of the cylinders 408*a,b* and extend toward the opposing cylinder 408*a,b*. The bottom of the transfer housing 406 may be open or otherwise exposed to accommodate the mold 300 within the interior and allow the mold 300 to directly contact the thermal heat sink 310, if desired. In other embodiments, the transfer housing 406 may include a bottom portion (not shown) that interposes the mold 300 and any underlying substrate. The transfer housing 406 may be coupled to the arm 404 and the first and second half-cylinders 408*a,b* may be actuated to an open position (shown in FIG. 4B) to receive the mold 300. As shown in FIG. 4C, the mold transfer assembly 402 may be moved toward the mold 300 in the first direction A and the transfer housing 406 may be actuated to a closed position, where the first and second half-cylinders 408*a,b* move to receive and enclose the mold 300 within the interior of the transfer housing 406.

In some embodiments, the transfer housing 406 may be sized such that the first and second half-cylinders 408*a,b* overlap each other a short distance upon moving to the closed position, and thereby substantially encapsulating the mold 300 within the transfer housing 406. Moreover, in some embodiments, the transfer housing 406 may include various internal features that provide an offset (radial and/or axial) between the inner surfaces of the transfer housing 406 and the outer surfaces of the mold 300. Suitable internal features include one or more annular rings defined on the inner surfaces of the first and second half-cylinders 408*a,b* and axially spaced from each other along a height of the transfer housing 406. Another suitable internal feature includes longitudinal ribs defined on the inner surfaces of the first and second half-cylinders 408*a,b* and extending along all or a portion of the height of the transfer housing 406. As will be appreciated, such internal features may prevent the mold 300 from physically engaging the inner surfaces of the first and second half-cylinders 408*a,b*, and thereby substantially preventing heat loss through conduction. The internal features may also prove advantageous in maintaining the mold 300 centered within the transfer housing 406, especially during the transfer process from the furnace floor 304 to the thermal heat sink 310. Moreover, these internal features may also be actuatable such that they protrude and/or retract so that they may be selectively in contact with the mold 300 during at least a portion of the transfer process. Again, this may prove advantageous in providing alignment and minimal contact. It may also prove advantageous to have rotatable, retractable, recessable, etc. internal features to further minimize or completely remove contact with the mold 300 at other times, such as when the transfer is complete.

Figure 4E:
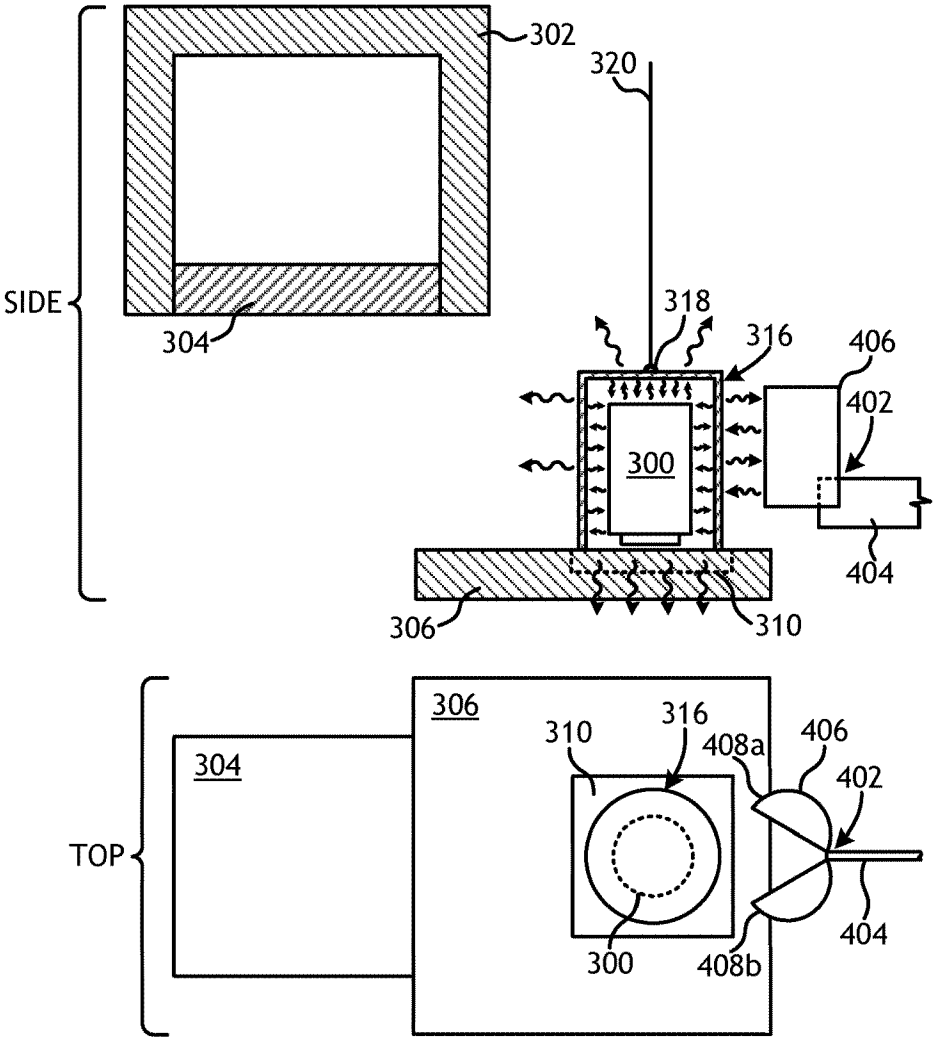
Figure 4D:
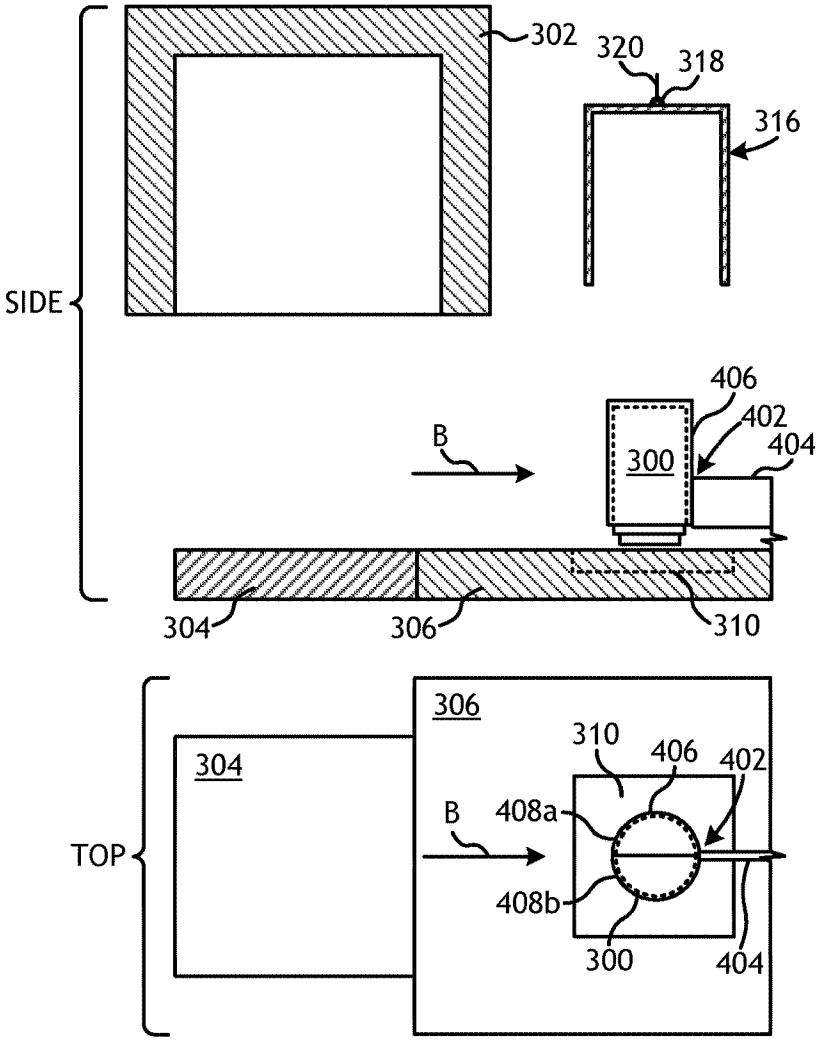

Once the mold 300 is secured within the transfer housing 406, the mold transfer assembly 402 may move in the second direction B to move the mold 300 towards its final resting place on the thermal heat sink 310, as shown in FIG. 4D. In some embodiments, once properly placed on the thermal heat sink 310, the mold transfer assembly 402 may be retracted from the mold 300, as shown in FIG. 4E. In the illustrated embodiment, for instance, the transfer housing 406 may again be actuated to its open position such that the first and second half-cylinders 408*a,b* expand and release the mold 300. The arm 404 may then be retracted from the mold 300 and the insulation enclosure 316 may subsequently be lowered around the mold 300 to reduce the amount of thermal energy radiating from the mold 300 from the top and sides of the mold 300.

In other embodiments, however, the arm 404 may be configured to detach from the transfer housing 406 and retract, thereby leaving the mold 300 encapsulated by the transfer housing 406. In such embodiments, the arm 404 may be detachably coupled to the transfer housing using a removable coupling, such as a hydraulic or pneumatic joint that releases upon command. As discussed in greater detail below, the transfer housing 406 may comprise materials that insulate the mold 300 and otherwise manipulate the thermal profile of the mold 300 as it is transferred from the furnace floor 304 to the thermal heat sink 310. As a result, the transfer housing 406 may be configured to substantially mitigate radiative and/or convective heat losses during the transfer. Moreover, the transfer housing 406 may help facilitate directional solidification of the mold 300 through the bottom of the mold 300, which is exposed and otherwise in direct contact with the thermal heat sink 310 while the sides of the mold 300 are insulated with the transfer housing 406. Accordingly, in such embodiments, the transfer housing 406 by itself may be manufactured and otherwise configured to promote directional solidification of the molten contents within the mold 300. Moreover, in such embodiments, the insulation enclosure 316 may be unnecessary and otherwise omitted from the system, if desired.

In yet other embodiments, however, the arm 404 may detach from the transfer housing 406 and retract, thereby leaving the mold 300 encapsulated by the transfer housing 406, and the insulation enclosure 316 may then be lowered over the transfer housing 406 and the mold 300. In such embodiments, the transfer housing 406 and the insulation enclosure 316 may operate in concert to promote directional solidification of the molten contents within the mold 300.

As will be appreciated, besides the advantages described above, the transfer housing 406 may further prove advantageous for various safety reasons. For instance, the transfer housing 406 is larger than the tongs 314 of FIGS. 3B-3E and, therefore, provides added safety in moving the mold 300 laterally. Whereas the tongs 314 grasp onto the mold 300 at a limited peripheral location, the transfer housing 406 substantially encapsulates the mold 300 and ensures that the mold 300 does not tip over during the transfer process. Moreover, the mold 300 can sometimes crack during transfer and its molten materials can leak out of the mold 300. Since the transfer housing 406 substantially encapsulates the mold 300, any molten leakage may be mitigated and otherwise contained. In such embodiments, the transfer housing 406 may further include a bottom trough or reservoir (not shown) used to catch and retain any molten leakage migrating out of a cracked mold 300.

Those skilled in the art will readily appreciate that the clam-shell transfer housing 406 may be naturally expanded to include any design that encloses or encapsulates the mold 300 as it is removed from the furnace 302 to the thermal heat sink 310. For instance, the clam-shell design may comprise two cylindrical walls and a circular top that may be hinged to or integral with one of the cylindrical walls or otherwise placed atop the cylindrical walls to complete the enclosure. Moreover, the clam-shell design may utilize more than two portions (i.e., the first and second half-cylinders 408*a,b*) to provide its required function. For instance, it is also contemplated herein to use a clam-shell design for the transfer housing 406 that provides a three-sided, open-ended structure, with a triangular top, or a four-sided, open-ended prism with a square or rectangular top. The top in any of these designs may form an integral part of any of the components or may otherwise be hinged to any of the components and pivoted into place for operation. Moreover, such designs could include independent actuation between the different members. As will be appreciated, other polygonal designs may be equally applicable and generally characterized as a clam-shell design of the transfer housing 406, without departing from the scope of the disclosure. Accordingly, the transfer housing 406, along with appropriate internal features described above, may prove advantageous in engaging and moving the mold 300 in a stable manner to the thermal heat sink 310, and thereby effectively replacing the need for tongs 314 (FIGS. 3B-3E) and minimizing the time the mold 300 remains uninsulated.

Figure 5A:
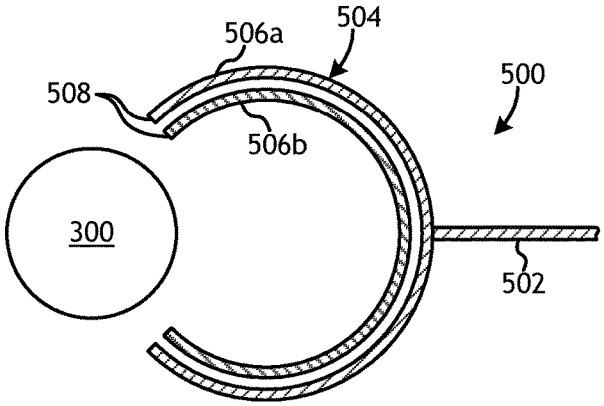
FIGS. 5A and 5B, illustrate a partial cross-sectional top view of an example mold transfer assembly.
Figure 5B:
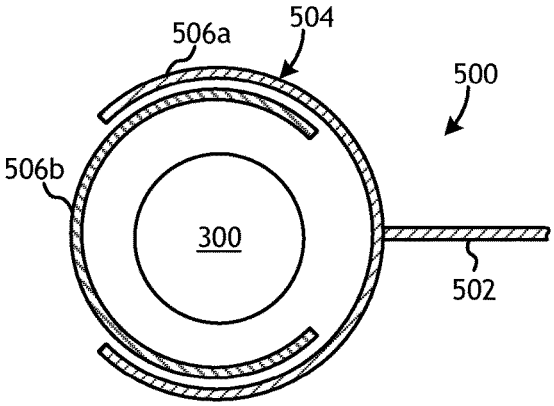

Referring now to FIGS. 5A and 5B, illustrated is a partial cross-sectional top view of an exemplary mold transfer assembly 500, according to one or more embodiments. The mold transfer assembly 500 may be similar in some respects to the mold transfer assembly 402 of FIGS. 4B-4E and, therefore, may be configured to move and otherwise transfer the mold 300 from the furnace floor 304 (FIGS. 4B-4E) to the thermal heat sink 310 (FIGS. 4B-4E). As with the mold transfer assembly 402 of FIGS. 4B-4E, the mold transfer assembly 500 may be operated manually or with a computer automated system.

As illustrated, the mold transfer assembly 500 may include an arm 502 and a transfer housing 504 coupled to an end of the arm 502. As with the transfer housing 406 of FIGS. 4B-4E, the transfer housing 504 may be configured to receive and enclose the mold 300 for lateral transfer. To accomplish this, the transfer housing 504 may include two or more concentric cylinders, shown as a first or outer cylinder 506*a* and a second or inner cylinder 506*b*. Each cylinder 506*a,b* may provide sidewalls for the transfer housing 504 and further define an opening 508 large enough to receive the mold 300. One or both of the cylinders 506*a,b* may include a top (not shown) to extend over the top of the mold 300. In some embodiments, the openings 508 may extend 180° about the circumference of the cylinders 506*a,b*. In other embodiments, the openings 508 may extend about the circumference of the cylinders 506*a,b* less than or more than 180°, without departing from the scope of the disclosure. In the case of an outer cylinder 506*a* that extends less than 180°, two overlapping inner cylinders 506*b* may be utilized to completely enclose the existing gap that is greater than 180°.

In exemplary operation, the openings 508 may be aligned with the mold 300 and the mold transfer assembly 500 may be moved toward the mold 300 to receive the mold 300 within the cylinders 506*a,b*. As shown in FIG. 5B, once the mold 300 is positioned within the transfer housing 504 (i.e., the cylinders 506*a,b*), at least one of the cylinders 506*a,b* may be rotated with respect to the other to thereby encapsulate the mold 300 within the transfer housing 504. In the illustrated embodiment, the inner cylinder 506*b* may be rotated with respect to the outer cylinder 506*b* to encapsulate the mold 300. In other embodiments, however, the outer cylinder 506*a* may be rotated with respect to the inner cylinder 506*b* to encapsulate the mold 300. In yet other embodiments, both cylinders 506*a,b* may be rotated to encapsulate the mold 300. Once the mold 300 is enclosed within the transfer housing 504, the mold transfer assembly 500 may then move to transfer the mold 300 from the furnace floor 304 (FIGS. 4B-4E) to the thermal heat sink 310 (FIGS. 4B-4E).

In some embodiments, the mating interface(s) between the inner and outer cylinders 506*a,b* may provide a close-fitting seal that may reduce heat loss through the annular gap defined between the two cylinders 506*a,b*. Moreover, in some embodiments, the transfer housing 504 may include various internal features that provide an offset (radial and/or axial) between the inner surfaces of the transfer housing 504 and the outer surfaces of the mold 300. Suitable internal features include those described herein above.

In some embodiments, the inner and outer cylinders 506*a,b* of the transfer housing 504 may be independent and otherwise non-concentric. In such embodiments, the inner cylinder 506*b*, for example, may be coupled to the arm 502 to be moved into contact with the mold 300 as positioned on the furnace floor 304 (FIGS. 4B-4E). The arm 502 and the inner cylinder 506*b* may then cooperatively push the mold 300 off the furnace floor 304 in the same initial direction to be received by the outer cylinder 506*b*. The inner and outer cylinders 506*a,b* may mate and cooperatively extend about the outer periphery of the mold 300, and thereby provide insulation for the mold 300 as the arm 502 continues pushing the mold 300 (and each of the inner and outer cylinders 506*a,b*) toward the thermal heat sink 310 (FIGS. 4B-4E) for cooling.

In another embodiment where the first and second cylinders 506*a,b* of the transfer housing 504 are independent and otherwise non-concentric, the inner cylinder 506*a* may be attached to a first arm whereas the second cylinder 506*b* may be attached to a second arm. The first and second arms may be, for example, positioned on opposing sides of the furnace 302 (FIGS. 4B-4E). In operation, both arms may move toward the mold 300 once exposed to lock the first and second cylinders 506*a,b* together around the mold 300. Once the first and second cylinders 506*a,b* are coupled, the second arm may disengage from the second cylinder 506*b* and the first arm may operate to retract the mold 300 and cylinder assembly (i.e., the combined first and second cylinders 506*a,b*) toward the thermal heat sink 310 via the transfer floor 306.

Alternatively, the two cylinders 506*a,b* may be attached to two arms or two extensions extending from a single arm 502 [e.g., a Y-shaped joint; rotatable at the junction to allow for actuation of the arms (at least, roughly) perpendicular to the direction of arm travel]. In such an embodiment, the two cylinders 506*a,b* may join together from opposite sides of the mold 300 and allow for the arm 502 to pull the mold 300 out in direction B (rather than pushing all the way through, as mentioned above).

In yet other embodiments, the first cylinder 506*a* may be attached to the arm 502 while the second cylinder 506*b* may be attached to the first cylinder 506*a* at its top, allowing for rotation of the second cylinder 506*b* into a horizontal position above the first cylinder 506*a*. Such operation allows the mold transfer assembly 500 to move into the furnace 302 (FIGS. 4B-4E) with the first cylinder 506*a* adjacent the mold 300, while the second cylinder 506*b* moves over the mold 300, after which it rotates down to couple with the first cylinder 506*a* while also being adjacent the mold 300. Once locked to the first cylinder 506*a*, the second cylinder 506*b* may be used to pull the mold 300 out of the furnace 302. Alternatively, the second cylinder 506*b* may be directly attached to the arm 502 to travel into the furnace 302 above the mold 300 horizontally, after which it rotates down to be in contact with the mold 300 to pull it out onto the thermal heat sink 310 (FIGS. 4B-4E) where the first cylinder 506*a* resides through the whole process.

Figure 6A:
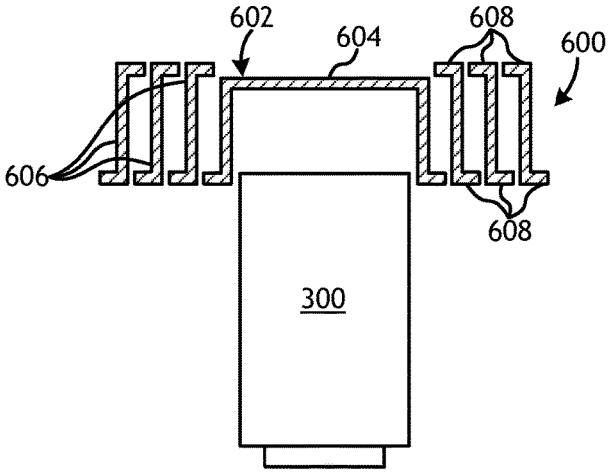
FIGS. 6A and 6B, illustrate a partial cross-sectional side view of another example mold transfer assembly.
Figure 6B:
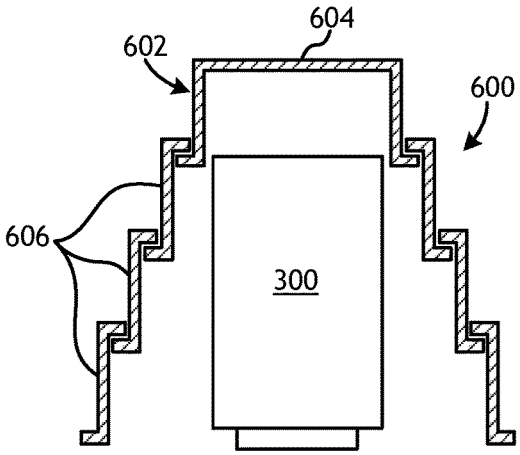

Referring now to FIGS. 6A and 6B, illustrated is a partial cross-sectional side view of another exemplary mold transfer assembly 600, according to one or more embodiments. The mold transfer assembly 600 may be similar in some respects to the mold transfer assembly 500 of FIGS. 5A and 5B and, therefore, may be configured to move and otherwise transfer the mold 300 from the furnace floor 304 (FIGS. 4B-4E) to the thermal heat sink 310 (FIGS. 4B-4E). Moreover, the mold transfer assembly 600 may be operated manually or by using a computer automated system.

The mold transfer assembly 600 may include a transfer housing 602 configured to encapsulate the mold 300 for movement or transfer. While not shown, the mold transfer assembly 600 may include an arm used to move the transfer housing 602 into the vicinity of the mold 300 to locate and enclose the mold 300. As illustrated, the transfer housing 602 may include a central cap 604 and a plurality of nested cylinders 606 concentrically arranged about the central cap 604. The central cap 604 may provide a top for the transfer housing 602, and the nested cylinders 606 may provide sidewalls for the transfer housing 602. As will be appreciated, the components of the transfer housing 602 are depicted in FIGS. 6A and 6B as enlarged and otherwise not drawn to scale for purposes of clarity in describing the novel features.

In exemplary operation, the transfer housing 602 may be moved above the mold 300 and subsequently actuated and otherwise manipulated such that the nested cylinders 606 drop and/or extend along the sides of the mold 300, as shown in FIG. 6B. The nested cylinders 606 may each include complimentary interlocking shoulders 608 that receive a corresponding shoulder 608 of a nested cylinder 606 positioned radially outward therefrom. Consequently, much like the operation of a collapsible drinking cup, the nested cylinders 606 may interlock with one another upon axial expansion for retention and encapsulation of the mold 300. Once the transfer housing 602 properly encloses the mold 300, the mold transfer assembly 600 may then be used to move or transfer the mold 300 from the furnace floor 304 (FIGS. 4B-4E) to the thermal heat sink 310 (FIGS. 4B-4E). Once on the thermal heat sink 310, the transfer housing 602 may help facilitate directional solidification of the mold 300 through the bottom of the mold 300, which is exposed and otherwise in direct contact with the thermal heat sink 310 while the sides of the mold 300 are insulated with the transfer housing 602. Moreover, while not shown, the transfer housing 602 may include various internal features that provide an offset (radial and/or axial) between the inner surfaces of the transfer housing 602 and the outer surfaces of the mold 300. Suitable internal features include those described herein above.

Figure 6C:
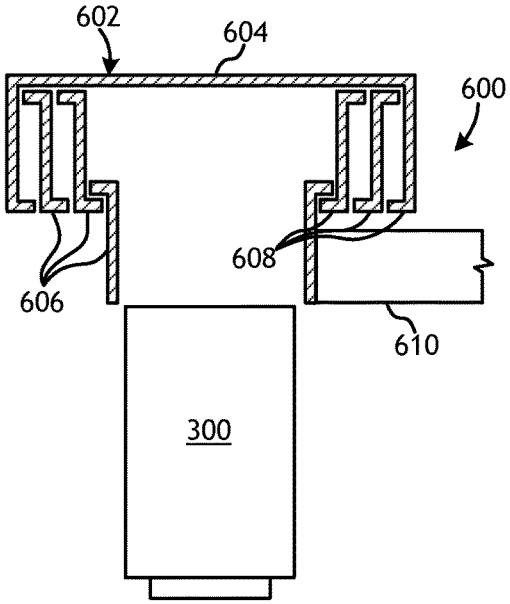
FIGS. 6C-6F illustrate partial cross-sectional side views of additional example mold transfer assemblies.
Figure 6D:
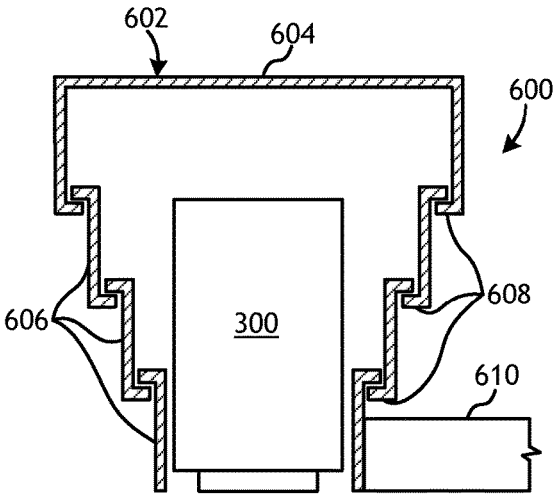

FIGS. 6C-6F depict variations of the transfer mold transfer assembly 600 of FIGS. 6A and 6B, according to one or more additional embodiments. In FIGS. 6C and 6D, the transfer housing 602 is able to encapsulate the mold 300 for movement or transfer via an arm 610 coupled to or otherwise in contact with the transfer housing 602. The arm 610 may operate to move the transfer housing 602 into the vicinity of the mold 300 to locate and enclose the mold 300. Similar to the embodiments of FIGS. 6A-6B, the transfer housing 602 includes the central cap 604 and the nested cylinders 606 concentrically arranged about the central cap 604, and also includes complimentary interlocking shoulders 608 that receive a corresponding shoulder 608 of a radially adjacent nested cylinder 606. As the arm 610 descends with respect to the mold, the nested cylinders 606 may correspondingly drop and/or extend along the sides of the mold 300, as shown in FIG. 6D. The bottom-most nested cylinder 606 may be positioned closer to the mold 300 than the remaining nested cylinders, thereby helping to reduce the chance of the mold 300 tipping while being transferred.

Figure 6E:
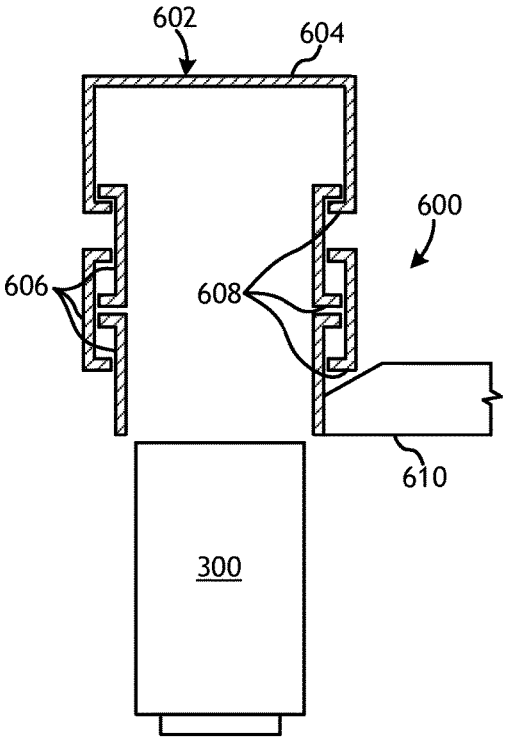
Figure 6F:
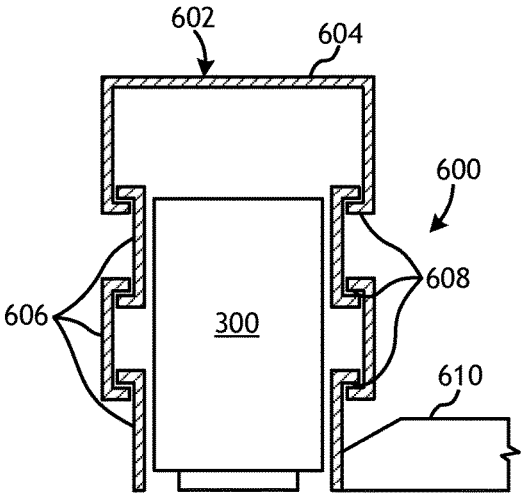

In FIGS. 6E-6F, the transfer housing 602 is again able to encapsulate the mold 300 for movement or transfer via the arm 610 coupled to or otherwise in contact with the transfer housing 602. Similar to the embodiments of FIGS. 6A-6B, the transfer housing 602 includes the central cap 604 and the nested cylinders 606 concentrically arranged about the central cap 604, and also includes complimentary interlocking shoulders 608 that receive a corresponding shoulder 608 of a radially adjacent nested cylinder 606. In FIGS. 6E and 6F, however, the nested cylinders 606 radially alternate along the axial height of the mold 300. As the arm 610 descends with respect to the mold, the nested cylinders 606 may correspondingly drop and/or extend along the sides of the mold 300, as shown in FIG. 6F. The radially alternating nested cylinders 606 may prove advantageous in providing a more uniform mold-to-cylinder distance or otherwise provide a reduced volume within the transfer housing 602.

As with the embodiments of FIGS. 6A and 6B, the transfer housing 602 in FIGS. 6C-6F may further include various internal features that provide an offset (radial and/or axial) between the inner surfaces of the transfer housing 602 and the outer surfaces of the mold 300. Suitable internal features include those described herein above.

The transfer housing of any of the mold transfer assemblies described herein may be configured to encapsulate or substantially encapsulate the mold 300 to insulate the mold 300 and/or otherwise control the thermal energy release from the mold 300 as it is moved between the furnace floor 304 (FIGS. 4B-4E) and the thermal heat sink 310 (FIGS. 4B-4E). This may be accomplished in several ways, and the following description provides various example transfer housings. It will be appreciated that the aspects of the transfer housings discussed below may be applicable to any transfer housing contemplated herein, without departing from the scope of the disclosure. Moreover, it will be appreciated that any of the transfer housings described herein may be configured to regulate the thermal profile of the mold 300 with or without the help of the insulation enclosure 316 (FIGS. 4B-4E). Accordingly, the transfer housings described herein may each be configured to operate independent of the insulation enclosure 316, operate in concert with the insulation enclosure 316 (i.e., received into the insulation enclosure 316), or retract from the mold 300 such that the insulation enclosure 316 may be lowered around the mold 300.

Figure 7:
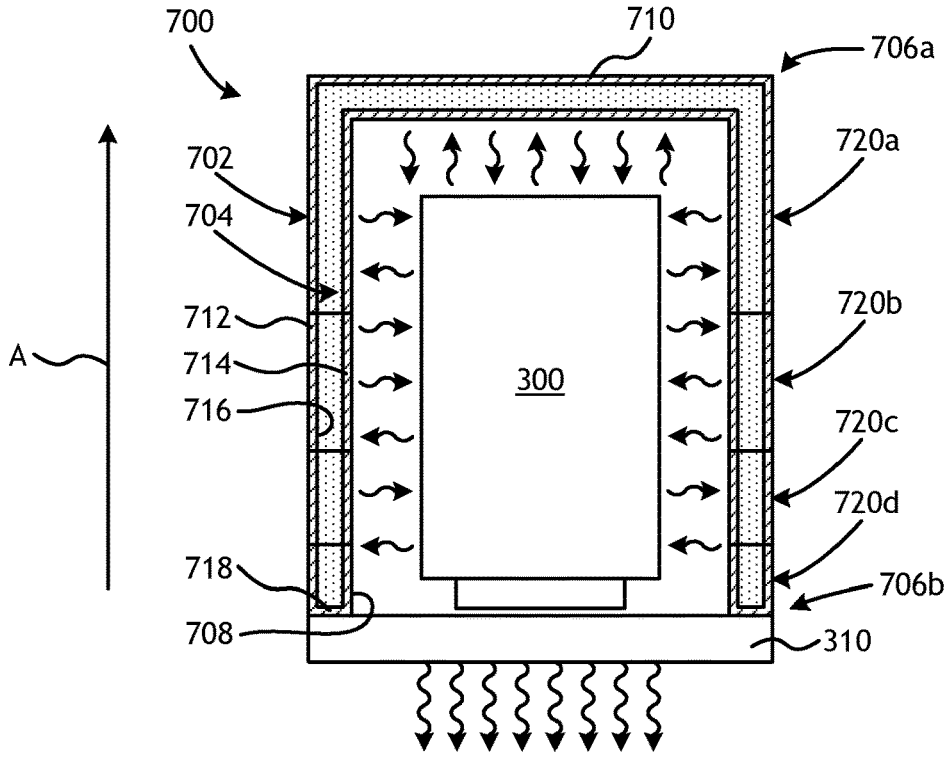
FIG. 7 is a cross-sectional side view of an exemplary transfer housing.

FIG. 7 is a cross-sectional side view of an exemplary transfer housing 700 as set upon the thermal heat sink 310, according to one or more embodiments. The transfer housing 700 may be representative of any of the transfer housings described herein. More specifically, regardless of the particular structural depiction shown in FIG. 7, the principles and elements discussed with respect to the transfer housing 700 may be applicable to any of the transfer housings contemplated herein, without departing from the scope of the present disclosure. The transfer housing 700 may form part of a mold transfer assembly and, while not illustrated, the transfer housing 700 may be coupled to an arm that also forms part of the mold transfer assembly and helps move the transfer housing 700 so that it can encapsulate and transfer the mold 300 from the furnace floor 304 (FIGS. 4B-4E) to the thermal heat sink 310.

The transfer housing 700 may include a support structure 702 and thermal material 704 supported by the support structure 702. In the illustrated embodiment, the transfer housing 700 (e.g., the support structure 702) is depicted as an open-ended cylindrical structure having a top end 706*a* and bottom end 706*b*. In other embodiments, however, the transfer housing may incorporate any of the designs discussed herein, without departing from the scope of the disclosure. As illustrated, the bottom end 706*b* may be open and the support structure 702 may define an interior 708 configured to receive the mold 300. The support structure 702 may provide and otherwise define sidewalls for the transfer housing 700, and the top end 706*a* may include a top 710 that may form an integral part of the support structure 702 or may alternatively be hinged to the support structure 702 and closed during operation.

The thermal material 704 may generally extend between the top and bottom ends of the support structure 702. The thermal material 704 may be supported by the support structure 702 via various configurations of the transfer housing 700. For instance, as depicted in the illustrated embodiment, the support structure 702 may include an outer frame 712 and an inner frame 714, which may be collectively referred to herein as the support structure 702. The outer and inner frames 712, 714 may cooperatively define a cavity 716, and the cavity 716 may be configured to receive and otherwise house the thermal material 704. In some embodiments, as illustrated, the support structure 702 may further include a footing 718 at the bottom end 706*b* of the transfer housing 700 that extends laterally between the outer and inner frames 712, 714. The footing 718 may serve as a support for the thermal material 704, and may prove especially useful when the thermal material 704 includes stackable and/or individual component insulative materials that may be stacked atop one another within the cavity 716.

In other embodiments, however, the outer frame 712 may be omitted from the transfer housing 700 and the thermal material 704 may alternatively be coupled to the inner frame 714 and/or otherwise supported by the footing 718. In yet other embodiments, the inner frame 714 may be omitted from the transfer housing 700 and the thermal material 704 may alternatively be coupled to the outer frame 714 and/or otherwise supported by the footing 718, without departing from the scope of the disclosure.

The support structure 702, including one or both of the outer and inner frames 712, 714, may be made of any rigid material including, but not limited to, metals, ceramics (e.g., a molded ceramic substrate), composite materials, combinations thereof, and the like. In at least one embodiment, the support structure 702, including one or both of the outer and inner frames 712, 714, may be a metal mesh. The support structure 702 may exhibit any suitable horizontal cross-sectional shape that will accommodate the general shape of the mold 300 including, but not limited to, circular, ovular, polygonal, polygonal with rounded corners, or any hybrid thereof. In some embodiments, the support structure 702 may exhibit different horizontal cross-sectional shapes and/or sizes at different vertical or longitudinal locations. Moreover, while not shown, the transfer housing 700 may further include various internal features that provide an offset (radial and/or axial) between the inner surfaces of the support structure 702 and the outer surfaces of the mold 300. Suitable internal features include those described herein above.

In some embodiments, the thermal material 704 may be configured to provide insulation or insulative properties to the transfer housing 700. In such embodiments, the thermal material 704 may prevent and otherwise retard heat transfer through the outer and inner frames 712, 714 and to the surrounding environment. Suitable insulation materials that may be used as the thermal material 704 include, but are not limited to, ceramics (e.g., oxides, carbides, borides, nitrides, and silicides that may be crystalline, non-crystalline, or semi-crystalline), ceramic-fiber blankets, metals, insulating metal composites, carbon, nanocomposites, foams, fluids (e.g., air), any composite thereof, or any combination thereof. The thermal material 704 may further include, but is not limited to, materials in the form of beads, cubes, pellets, particulates, powders, flakes, fibers, wools, woven fabrics, bulked fabrics, sheets, bricks, stones, blocks, cast shapes, molded shapes, sprayed insulation, and the like, any hybrid thereof, or any combination thereof. Accordingly, examples of suitable materials that may be used as the thermal material 704 may include, but are not limited to, ceramics, ceramic fibers, ceramic fabrics, ceramic wools, ceramic beads, ceramic blocks, ceramic powders, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metals, metal powders, intermetallic powders, metal fabrics, metal foams, metal wools, metal castings, glasses, glass beads, and the like, any composite thereof, or any combination thereof.

In some embodiments, the cavity 716 may be sealed, thereby allowing a gas or liquid to be used as the thermal material 704. Suitable gases that may be sealed within the cavity 716 include, but are not limited to, air, argon, neon, helium, krypton, xenon, oxygen, carbon dioxide, methane, nitric oxide, nitrogen, nitrous oxide, or any combination thereof. In at least one embodiment, the cavity 716 may contain a connection to an exterior reservoir that provides heated gas to the cavity 716 to serve as a thermal energy reservoir. In this manner, a heated gas may be used to fill the cavity 716 once, or a heated gas may continuously cycle through the cavity 716 to provide a suitable thermal reservoir. In other embodiments, the gas may be omitted from the cavity 716 and a vacuum may alternatively be formed within the cavity 716 to act as an insulator.

In some embodiments, the thermal material 704 may comprise a material that exhibits a high heat capacity such that the thermal material 704 is converted into and otherwise serves as a thermal mass or reservoir for the mold 300. More particularly, whereas thermal materials 704, such as a ceramic powder, are able to provide a level of insulation for the mold 300, thermal materials 704, such as metals, are able to absorb thermal energy such that the thermal material 704 may be transformed into a thermal reservoir. As a result, the rate of cooling in the center regions of the mold 300 may be reduced axially. It will be appreciated, however, that the heat capacity and insulation properties of various thermal materials 704 can also be employed simultaneously if benefit to the directional cooling can be obtained in such a fashion.

A thermal material 704 acting as a thermal reservoir may comprise a material in the form of blocks, cubes, pellets, particulates, flakes, and/or a powder. Generally, the thermal material 704 acting as a thermal reservoir for the transfer housing 700 may include any metal, salt, or ceramic that exhibits a suitable heat capacity, thermal conductivity, thermal diffusivity, melting range (liquidus and solidus), and/or latent heat of fusion to provide the maximum amount of thermal resistance at, near, above, or below the liquidus and/or the solidus temperatures of the binder material used to form the metal matrix composite tool (e.g., the drill bit 100 of FIG. 1) within the mold 300. Using a thermal material 704 that is similar to the binder material may prove advantageous since they will each have the same solidus and liquidus temperatures. As a result, the thermal material 704 may be able to provide latent heat to the molten contents of the mold 300 at essentially the same thermal points. In some embodiments, however, the thermal materials 704 may exhibit melting ranges that are sufficiently high so that they will not melt during the infiltration process and instead serve as a thermal reservoir during the cooling process.

Suitable metals for the thermal material 704 acting as a thermal reservoir may include a metal similar to the binder material such as, but not limited to, copper, nickel, manganese, lead, tin, cobalt, silver, phosphorous, zinc, any alloys thereof, and any mixtures of the metallic alloys. Alternatively, a commercially pure metal may be used as a thermal reservoir if it has suitably high melting and boiling points in addition to a suitably low thermal diffusivity. Thermal diffusivity is equal to thermal conductivity divided by the product of density and specific heat. In essence, thermal diffusivity is a measure of the ability of a material to conduct heat versus its capability to retain heat. Silver, gold, and copper have very high thermal conductivities, especially in their pure (unalloyed) forms; correspondingly, they also have high thermal diffusivities (17.4, 12.8, and 11.7 $m^2/s$, respectively). An ideal metal that could function as a suitable thermal reservoir, due to its low thermal diffusivity (0.2 $m^2/s$), while also possessing suitably high melting and boiling points, is manganese, which also has a low thermal conductivity (7.8 W/m*K). Additional suitable metals that may be used for the thermal material 704 as a thermal reservoir include gadolinium, bismuth, terbium, dysprosium, cerium, samarium, scandium, erbium, and actinium (thermal diffusivity below 0.1 $m^2/s$ and thermal conductivity less than or equal to 16 W/m*K). Other suitable metals are also possible with adequately low thermal conductivities and diffusivities. Generally, suitable materials may have upper limits of thermal conductivity of 25 W/m*K, of thermal diffusivity of 0.2 m^2/s, and of boiling point of 2200° F. Due to the propensity of many of these metals to oxidize, it is preferable to incorporate the metal in an evacuated or sealed chamber in the transfer housing 700 or in proximity to a gettering agent (a material that will preferentially oxidize), or to provide a controlled atmosphere (e.g., vacuum, argon, helium, hydrogen) in the transfer housing 700.

Prior to encapsulating the mold 300 within the transfer housing 700, the thermal material 704 acting as a thermal reservoir may be heated to absorb thermal energy and, in at least one embodiment, may become molten. Upon receiving the mold 300 within the transfer housing 700, the thermal material 704 may provide heat to the molten contents within the mold 300, and thereby slow its cooling rate and otherwise help directional solidification. In embodiments where the thermal material 704 becomes molten, the molten thermal material 704 may progress through a phase change from a liquid state to a solid state. As the molten thermal material 704 cools and, therefore, proceeds through a phase change process (if applicable), latent heat involved with the phase change may be released from the molten thermal material 704 until the molten mass solidifies. As will be appreciated, the time required for the molten thermal material 704 to solidify may prove advantageous in providing additional time to allow thermal energy to be removed through the bottom of the mold 300 via the thermal heat sink 310, and thereby help directionally solidify the molten contents within the mold 300.

In some embodiments, the thermal material 704 may be configured to provide or extract latent heat as the result of an exothermic or endothermic chemical reaction occurring within the cavity 716. In other embodiments, the thermal material 704 may provide latent heat as the result of an allotropic phase change occurring within the cavity 716. For example, some materials used as the thermal material 704, such as iron, undergo a crystal structure change [i.e., between body-centered cubic (BCC) and face-centered cubic (FCC)] while being heated or cooled through certain temperature ranges. During the transition between crystalline structures, the iron thermal material 704 may be able to provide a specific and known energy transfer for a certain amount of time.

In some embodiments, in addition to the thermal material 704, or independent thereof, a reflective coating may be applied to a surface of one or both of the outer and inner frames 712, 714. More specifically, the reflective coating may be applied to the inner surface (i.e., within the cavity 716) of one or both of the outer or inner walls 712, 714, or to the outer surface (i.e., without the cavity 716) of one or both of the outer or inner walls 712, 714, without departing from the scope of the disclosure. The reflective coating may be adhered to and/or sprayed onto surfaces of the outer and inner frames 712, 714 to reflect an amount of thermal energy emitted from the molten contents of the mold 300 back toward the molten contents.

Suitable materials for the reflective coating include a metal coating selected from group consisting of iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, or any alloy based on these metals. A metal reflective coating may be applied via a suitable method, such as plating, spray deposition, chemical vapor deposition, plasma vapor deposition, etc. Another suitable material for the reflective coating may be a paint, ceramic, or metal oxide (e.g., white for high reflectivity, black for high absorptivity). In other embodiments, or in addition thereto, the inner surface of one or more of the outer and inner frames 712, 714 may be polished so as to increase its emissivity.

In some embodiments, in addition to the thermal material 704, or independent thereof, a thermal barrier may be applied to a surface of one or both of the outer and inner frames 712, 714. More specifically, the thermal barrier may be applied to the inner surface (i.e., within the cavity 716) of one or both of the outer or inner walls 712, 714, or to the outer surface (i.e., without the cavity 716) of one or both of the outer or inner walls 712, 714, without departing from the scope of the disclosure. The thermal barrier may provide resistance to heat transfer between the thermal material 704 and the exterior of the transfer housing 700.

Suitable materials that may be used as the thermal barrier include, but are not limited to, aluminum oxide, aluminum nitride, silicon carbide, silicon nitride, quartz, titanium carbide, titanium nitride, yttria-stabilized zirconia, borides, carbides, nitrides, and oxides. The thermal barrier may be applied to surfaces of the outer and inner frames 712, 714 via a variety of processes or techniques including, but not limited to, electron beam physical vapor deposition, air plasma spray, high velocity oxygen fuel, electrostatic spray assisted vapor deposition, chemical vapor deposition, and direct vapor deposition. The thermal barrier may advantageously lower the radiosity (e.g., radiant heat flux) and/or lower the heat transfer through the transfer housing 700, thereby helping maintain heat within the mold 300 and otherwise promote its ability to redirect thermal energy back at the molten contents within the mold 300.

In some embodiments, the transfer housing 700 may comprise a radiant barrier configured to redirect thermal energy radiated from the mold 300 back towards the mold 300. As will be appreciated, redirecting radiated thermal energy back towards the mold 300 may help slow the cooling process of the mold 300, and thereby help control the thermal profile of the mold 300 for directional solidification of its molten contents. Acting as a radiant barrier, the transfer housing 700 may be made of materials that allow the inner surface of the transfer housing (e.g., the surface that faces the mold 300 within the interior 708) to exhibit a high radiosity (J) and, therefore, be able to substantially redirect thermal energy radiated from the mold 300 back towards the mold 300. In the illustrated embodiment, the inner surface of the transfer housing 700 may be the inner surface of the inner wall 714 or, alternatively, the inner surface of the outer wall 716 when the inner wall 714 is omitted.

The radiosity of a surface is a measure of its effectiveness at projecting radiant energy and is defined as the sum of the emissive power of a surface (E) and reflected incident radiation ($\rho$*G), where reflectivity is denoted as $\rho$ and G represents incident radiation (or irradiation). The emissive power of a surface is defined as the emissive power of a blackbody surface ($E_b$) scaled by the emissivity of the surface ($\varepsilon$). The absorptivity of a surface is defined as the incident radiation that is not reflected ($\alpha=1-\rho$). It then follows that the radiosity encompasses the energy emitted by a surface due to its temperature and radiant energy that is reflected: $J=\varepsilon*E_b+(1-\alpha)*G$. A high radiosity can be achieved with a suitable combination of high emissivity ($\varepsilon$) and/or low absorptivity ($\alpha$), or a suitably low $\alpha/\varepsilon$ ratio. The back surface of the transfer housing 700 (e.g., the outer inner surface of the inner wall 714 or, alternatively, the outer surface of the outer wall 716 when the inner wall 714 is omitted) may be prepared such that it exhibits low radiosity, which can be achieved with a suitable combination of low emissivity and/or high absorptivity, or a suitably high $\alpha/\varepsilon$ ratio. The back surface may also be suitably insulated.

Suitable materials for the transfer housing 700 acting as a radiant barrier include, but are not limited to, ceramics and metals, which may include certain surface preparations or coatings. Suitable ceramics may include aluminum oxide, aluminum nitride, silicon carbide, silicon nitride, quartz, titanium carbide, titanium nitride, borides, carbides, nitrides, and oxides. Suitable metals may include iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, or any alloy based on these metals.

Suitable surface preparations may include oxidizing, or any suitable method to modify the surface roughness, such as machining, polishing, grinding, honing, lapping, or blasting. In some embodiments, the emissivity of the front surface may further be enhanced by polishing the front surface so that a highly reflective surface results.

Suitable coatings may include a metal coating (selected from the previous list of metals and applied via a suitable method, such as plating, spray deposition, chemical vapor deposition, plasma vapor deposition, etc.), a ceramic coating (selected from the previous list of ceramics and applied via a suitable method), or a paint (e.g., white for high reflectivity, black for high absorptivity). The application of a surface preparation or coating can provide important properties for a suitable radiant barrier, as properties such as radiosity, reflectivity, emissivity, and absorptivity are often strongly based on surface properties and conditions. For example, polished aluminum is reported to have the following solar radiative properties: $\alpha_s=0.09$, $\varepsilon=0.03$, and $\alpha_s/\varepsilon=3.0$. Providing a quartz overcoating or anodizing produce higher emissivities and lower $\alpha/\varepsilon$ ratios: $\varepsilon=0.37$, $\alpha_s k=0.30$ and $\varepsilon=0.84$, $\alpha_s k=0.17$, respectively, thereby promoting radiosity [Fundamentals of Heat and Mass Transfer, Fifth Edition, Frank P. Incropera and David P. DeWitt, 2002, p. 931]. Due to the strong dependence of radiosity, emissivity, absorptivity, and reflectivity on surface properties and characteristics, a radiant barrier can be designed such that its inner core is a structural member for a suitable coating applied to its surface.

In some embodiments, the transfer housing 700 may be configured to control the thermal profile of the mold 300 during cooling by varying one or more thermal properties along a longitudinal direction A of the transfer housing 700. More particularly, one or more thermal properties of the transfer housing 700 may be altered from the bottom end **706*b* of the transfer housing 700 to the top end 706*a*. Exemplary thermal properties that may be varied in the longitudinal direction A include, but are not limited to, thermal resistance (i.e., R-value), thermal conductivity (k), specific heat capacity ($C_P$), density (i.e., weight per unit volume of the thermal material 704**), thermal diffusivity, temperature, surface characteristics (e.g., roughness, coating, paint), emissivity, absorptivity, and any combination thereof.

By varying the thermal properties in the longitudinal direction A, higher insulating properties at or near the top end **706*a* of the transfer housing 700 and lower insulating properties at or near the bottom end 706*b* may result. As a result, the rate of thermal energy loss through the transfer housing 700 may be graded in the longitudinal direction A, with more thermal energy being lost at or near the bottom end 706*b* as opposed to the top end 706*a*. Consequently, the thermal profile of the mold 300 may thereby be controlled such that directional solidification of the molten contents within the mold 300 is substantially achieved from the bottom of the mold 300 axially upward in the longitudinal direction A, rather than radially through the sides of the mold 300**.

To accomplish this, in some embodiments, the sidewalls of the transfer housing 700 may be divided into a plurality of insulation zones 720 (shown as insulation zones 720*a*, 720*b*, 720*c*, and 720*d*). While four insulation zones 720*a-d* are depicted, those skilled in the art will readily appreciate that more or less than four insulation zones 720*a-d* may be employed in the transfer housing 700, without departing from the scope of the disclosure. Indeed, the number of discrete insulation zones 720*a-d* may vary depending upon the specifications of the metal matrix composite tool or device being fabricated within mold 300 (e.g., the drill bit 100 of FIG. 1).

Varying at least one of the thermal resistance, thermal conductivity, specific heat capacity, density, thermal diffusivity, temperature, emissivity, and absorptivity along the longitudinal direction A of the transfer housing 700 may be accomplished passively by configuring the insulation zones 720*a-d* such that more thermal energy loss is permitted through the insulation zones 720*a-d* arranged at or near the bottom end 706*b* of the transfer housing 700 as compared to thermal energy loss permitted through the insulation zones 720*a-d* arranged at or near the top end 706*a*.

In at least one embodiment, for example, the support structure 702 and/or the thermal material 704 may be varied such that the thermal resistance (R-value) of the insulation zones 720*a-d* arranged at or near the bottom end 706*b* of the transfer housing 700 is less than the thermal resistance (R-value) of the insulation zones 720*a-d* arranged at or near the top end 706*a*. In such an embodiment, the first insulation zone 720*a* may exhibit a first R-value "$R_1$," the second insulation zone 720*b* may exhibit a second R-value "$R_2$," the third insulation zone 720*c* may exhibit a third R-value "$R_3$," and the fourth insulation zone 720*d* may exhibit a fourth R-value "$R_4$," where $R_1>R_2>R_3>R_4$. Accordingly, the R-value of the transfer housing 700 may increase in the longitudinal direction A from the bottom end 706*b* of the transfer housing 700 toward the top end 706*a* such that more thermal energy is retained at or near the top of the mold 300 while thermal energy is drawn out of the bottom via the thermal heat sink 310.

As will be appreciated by those skilled in the art, the graded R-values $R_1$-$R_4$ for each insulation zone 720*a-d* may be achieved in various ways, such as by using different materials for one or both of the support structure 702 and the thermal material 704 at each insulation zone 720*a-d*. The graded R-values for each insulation zone 720*a-d* may also be achieved by varying the thickness and/or density of one or both of the support structure 702 and the thermal material 704 at each insulation zone 720*a-d*. For instance, in one or more embodiments, the thermal material 704 of the insulation zones 720*a-d* arranged at or near the top end 706*a* of the transfer housing 700 may include multiple layers or wraps of thermal material 704, such as multiple layers or wraps of a ceramic fiber blanket (e.g., INSWOOL●). The increased thickness and/or density of the thermal material 704 of the insulation zones 720*a-d* arranged at or near the top end 706*a* may correspondingly increase the R-value. Accordingly, it is contemplated to vary the thickness of the thermal material 704 along the height of the transfer housing 700 and otherwise in the longitudinal direction A.

In other embodiments, the support structure 702 and/or the thermal material 704 may be varied such that the thermal conductivity (k) of the insulation zones 720*a-d* arranged at or near the bottom end 706*b* of the transfer housing 700 is greater than the thermal conductivity (k) of the insulation zones 720*a-d* arranged at or near the top end 706*a*. In such an embodiment, the first insulation zone 720*a* may exhibit a first thermal conductivity "$k_1$," the second insulation zone 720*b* may exhibit a second thermal conductivity "$k_2$," the third insulation zone 720*c* may exhibit a third thermal conductivity "$k_3$," and the fourth insulation zone 720*d* may exhibit a fourth thermal conductivity "$k_4$," where $k_1<k_2<k_3<k_4$. Accordingly, the thermal conductivity of the transfer housing 700 may decrease in the longitudinal direction A from the bottom end 706*b* of the transfer housing 700 toward the top end 706*a* such that more thermal energy is retained at or near the top of the mold 300 while thermal energy is drawn out of the bottom via the thermal heat sink 310.

Similar to the graded R-values, those skilled in the art will readily appreciate that the graded thermal conductivities $k_1$-$k_4$ for each insulation zone 720*a-d* may be achieved in various ways, such as by using more thermally conductive materials for one or both of the support structure 702 and the thermal material 704 at the insulation zones 720 at or near the bottom end 706*b* of the transfer housing 700. In at least one embodiment, for instance, the support structure 702 at the insulation zones 720 at or near the bottom end 706*b* of the transfer housing 700 may be at least partially made of a steel cage or metal mesh, which exhibits a high thermal conductivity. The graded thermal conductivities for each insulation zone 720*a-d* may also be achieved by varying the thickness and/or density of one or both of the support structure 702 and the thermal material 704 at each insulation zone 720*a-d*. Accordingly, this may yield a transfer housing 700 with highest insulating properties in the insulation zones 720*a-d* near the top end 706*a* of the transfer housing 700 and lowest insulating properties in the insulation zones 720*a-d* near the bottom end 706*b*.

In some embodiments, each insulation zone 720*a-d* of the transfer housing 700 may be independently actuatable. More particularly, each insulation zone 720*a-d* may be independently coupled to the arm (e.g., arm 404 of FIGS. 4B-4E) and thereby able to be independently actuated between open and closed positions during operation. Such an embodiment may be advantageous where the transfer housing 700 is similar to the clam-shell transfer housing 406 of FIGS. 4B-4E. In such embodiments, the various insulation zones 720*a-d* may be selectively actuated to move anywhere between closed and open positions to selectively alter the thermal profile of the mold 300 along the longitudinal direction A. For instance, in some embodiments, the lower insulation zones 720*c* and 720*d* may be actuated to an open or partially open position after the mold 300 has cooled for a predetermined amount of time, thereby allowing more heat transfer out of the sides of the mold 300. The upper insulation zones 720*a* and 720*b* may subsequently be opened or partially opened following another predetermined amount of cooling time. As a result, the thermal profile of the mold 300 may be altered in the longitudinal direction A by selectively actuating the insulation zones 720*a-d* of the transfer housing 700.

Figure 8:
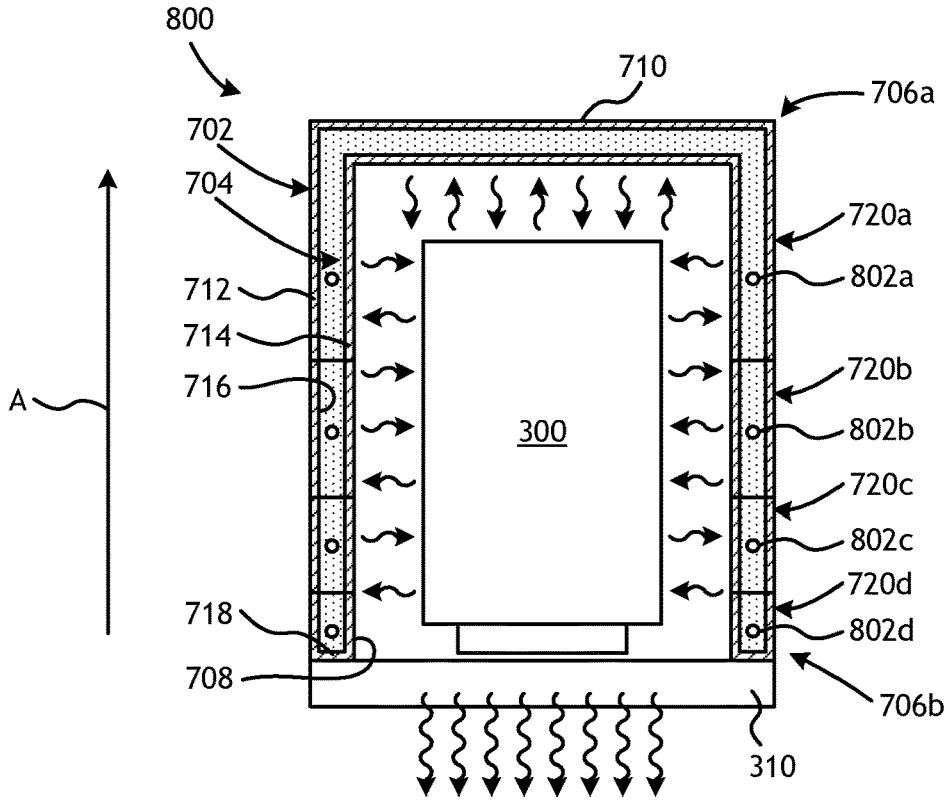
FIG. 8 is a cross-sectional side view of another exemplary transfer housing.

Referring now to FIG. 8, illustrated is a cross-sectional side view of another exemplary transfer housing 800, according to one or more embodiments. The transfer housing 800 may be representative of any of the transfer housings described herein. More specifically, regardless of the particular structural depiction shown in FIG. 8, the principles and elements discussed with respect to the transfer housing 800 may be applicable to any of the transfer housings contemplated herein, without departing from the scope of the present disclosure. Moreover, the transfer housing 800 may form part of a mold transfer assembly and, while not illustrated, the transfer housing 800 may be coupled to an arm that also forms part of the mold transfer assembly and helps move the transfer housing 800 so that it can encapsulate and transfer the mold 300 from the furnace floor 304 (FIGS. 4B-4E) to the thermal heat sink 310.

The transfer housing 800 may be similar in some respects to the transfer housing 700 of FIG. 7 and therefore may be best understood with reference thereto, where like numerals represent like components not described again. Similar to the transfer housing 700 of FIG. 7, the transfer housing 800 may not only be configured to encapsulate and insulate the mold 300 during the transfer process, but may also be configured to control the thermal profile of the mold 300 during cooling by varying one or more thermal properties along the longitudinal direction A of the transfer housing 800. As a result, the rate of thermal energy loss through the transfer housing 800 may be graded such that most thermal energy is lost at or near the bottom end 706*b* of the transfer housing 800 as opposed to the top end 706*a*.

In the illustrated embodiment, the transfer housing 800 may include one or more thermal elements 802 (shown as thermal elements 802*a*, 802*b*, 802*c*, and 802*d*) coupled to the support structure 702 and otherwise positioned within the cavity 716. As used herein, the term "positioned within" can refer to physically embedding the thermal elements 802*a-d* within the thermal material 704 in the cavity 716, but may also refer to embodiments where the thermal elements 802*a-d* are coupled to or form an integral part of the support structure 702 on either side of the outer and inner frames 712, 714. As illustrated, the first thermal element 802*a* is arranged in the first insulation zone 720*a*, the second thermal element 802*b* is arranged in the second insulation zone 720*b*, the third thermal element 802*c* is arranged in the third insulation zone 720*c*, and the fourth thermal element 802*d* is arranged in the fourth insulation zone 720*d*.

The thermal elements 802 may be in thermal communication with the mold 300. As used herein, the term "thermal communication," such as having the thermal elements 802*a-d* in "thermal communication" with the mold 300, may mean that activation of the thermal elements 802*a-d* may result in thermal energy being imparted and/or transferred to the mold 300 from the thermal elements 802*a-d*. According to the present disclosure, the mold 300 may be selectively and/or actively heated using the thermal elements 802*a-d*. More particularly, each thermal element 802*a-d* may be configured to actively vary the temperature of the mold 300 along the longitudinal direction A such that higher temperatures are maintained at or near the top end 706*a* of the transfer housing 800 as compared to lower temperatures being maintained at or near the bottom end 706*b*. As a result, more thermal energy losses are permitted through the insulation zones 720*a-d* arranged at or near the bottom end 706*b* of the transfer housing 800 as compared to thermal energy losses permitted through the insulation zones 720*a-d* arranged at or near the top end 706*a*.

The thermal elements 802*a-d* may be any device or mechanism configured to impart thermal energy to the mold 300. For example, the thermal elements 802*a-d* may include, but are not limited to, a heating element, a heat exchanger, a radiant heater, an electric heater, an infrared heater, an induction heater, one or more induction coils, a heating band, one or more heated coils, a heated cartridge, resistive heating elements, a refractory and conductive metal coil, strip, or bar, a microwave emitter, a tuned microwave receptive material, or any combination thereof. Suitable configurations for a heating element may include, but are not be limited to, coils, plates, strips, finned strips, and the like, or any combination thereof.

In some embodiments, the thermal elements 802*a-d* positioned in the cavity 716 may comprise a single thermal element 802*a-d* array and thereby form a helical or coiled single thermal element 802*a-d*. In such embodiments, the thermal element 802*a-d* may be controlled via a single lead (not shown) connected to the thermal element 802*a-d*. In such embodiments, the temperature within the transfer housing 800 may be varied in the longitudinal direction A by varying the density of the revolutions of the heating coil about/within the support structure 702. For instance, the revolutions of the heating coil may be denser at or near the top end 706*a* of the transfer housing 800 as opposed to the bottom end 706*b*, which may result in increased thermal input at the top end 706*a*.

In other embodiments, however, the thermal elements 802*a-d* in the mold 300 may comprise a collection of thermal elements 802*a-d* that may be controlled together, or two or more sets of thermal elements 802*a-d* that may be controlled independent of each other. In yet other embodiments, the thermal elements 802*a-d* in the mold 300 may comprise individual and discrete thermal elements 802*a-d* that are each powered independent of the others. In such embodiments, each thermal element 802*a-d* would require connection to a corresponding discrete lead to control and power the corresponding thermal elements 802*a-d*. As will be appreciated, such embodiments may prove advantageous in allowing an operator (or automated control system) to vary an intensity or heat output of each thermal element 802*a-d* independently, and thereby produce a desired heat gradient (also variable with time) within the mold 300.

While only four thermal elements 802*a-d* are depicted in FIG. 8, it will be appreciated that any number of thermal elements 802*a-d* may be employed in the transfer housing 800, without departing from the scope of the disclosure. Indeed, multiple thermal elements 802*a-d* may be required in one or more of the insulation zones 720*a-d* at or near the top end 706*a* of the transfer housing 800 to maintain elevated temperatures.

In some embodiments, the thermal elements 802*a-d* may alternatively comprise conduits configured to circulate a thermal fluid. Accordingly, the thermal elements 802*a-d* may alternatively be characterized as and otherwise referred to herein as "thermal conduits 802*a-d*." The thermal conduits 802*a-d* may be configured to place the thermal fluid in thermal communication with the mold 300. In some embodiments, for instance, thermal energy may be imparted and/or transferred to the mold 300 (or the contents thereof) from the thermal fluid. In other embodiments, however, the thermal fluid may be configured to extract thermal energy from the mold 300. Accordingly, circulating the thermal fluid through the thermal conduits 802*a-d* may allow an operator (or an automated control system) to selectively and/or actively alter the thermal profile of the mold 300.

The thermal fluid circulated in the thermal conduits 802*a-d* may be any fluidic substance that exhibits suitable properties, such as high thermal conductivity, high thermal diffusivity, high density, low viscosity (kinematic or dynamic), high specific heat, and high boiling point and low vapor pressure for liquids, to enable the thermal fluid to exchange thermal energy with the mold 300. Suitable thermal fluids include, but are not limited to, a gas (e.g., air, carbon dioxide, argon, helium, oxygen, nitrogen), water, steam, an oil, a coolant (e.g., glycols), a molten metal, a molten metal alloy, a fluidized bed, a molten salt, a fluidic exothermic reaction, or any combination thereof. Suitable molten metals or metal alloys used for the thermal fluid may include Pb, Bi, Pb—Bi, K, Na, Na—K, Ga, In, Sn, Li, Zn, or any alloys thereof. Suitable molten salts used for the thermal fluid include alkali fluoride salts (e.g., LiF—KF, LiF—NaF—KF, LiF—RbF, LiF—NaF—RbF), $BeF_2$ salts (e.g., LiF—$BeF_2$, NaF—$BeF_2$, LiF—NaF—$BeF_2$), $ZrF_4$ salts (e.g., KF—$ZrF_4$, NaF—$ZrF_4$, NaF—KF—$ZrF_4$, LiF—$ZrF_4$, LiF—NaF—$ZrF_4$, RbF—$ZrF_4$), chloride-based salts (e.g., LiCl—KCl, LiCl—RbCl, KCl—$MgCl_2$, NaCl—$MgCl_2$, LiCl—KCl—$MgCl_2$, KCl—NaCl—$MgCl_2$), fluoroborate-based salts (e.g., NaF—$NaBF_4$, KF—$KBF_4$, RbF—$RbBF_4$), or nitrate-based salts (e.g., $NaNO_3$—$KNO_3$, $Ca(NO_3)_2$—$NaNO_3$—$KNO_3$, $LiNO_3$—$NaNO_3$—$KNO_3$), and any alloys thereof.

The thermal conduits 802*a-d* may each be in fluid communication with a heat exchanger (not shown) configured to thermally condition the thermal fluid. As used herein, the term "thermally condition" refers to heating or cooling the thermal fluid. Whether the heat exchanger thermally conditions the thermal fluid by heating or cooling will depend on the application. The heat exchanger may include a pump (not shown) operable to circulate the thermal fluid through the thermal conduits 802*a-d* and back to the heat exchanger for continuous thermal conditioning of the thermal fluid. As will be appreciated, being able to selectively and actively adjust and otherwise optimize the level of directional heat imparted by the thermal fluid may prove advantageous in being able to vary the thermal profile within the mold 300.

In yet other embodiments, the temperature of the mold 300 may be actively varied along the longitudinal direction A by resistively heating the support structure 702 and, more particularly, the outer and/or inner frames 712, 714. In such embodiments, the outer and/or inner frames 712, 714 may comprise a metallic cage or metal mesh and may be communicably coupled to one or more resistive heat sources (not shown). In operation, electric current passing through the outer and/or inner frames 712, 714 may encounter resistance, thereby resulting in heating of the outer and/or inner frames 712, 714. Through such resistive heating, higher temperatures may be maintained adjacent the mold 300 at or near the top end 706*a* of the transfer housing 800 as compared to lower temperatures maintained at or near the bottom end 706*b*. Consequently, the thermal profile of the mold 300 may thereby be controlled such that directional solidification of the molten contents within the mold 300 is substantially achieved from the bottom of the mold 300 axially upward in the longitudinal direction A, rather than radially through the sides of the mold 300.

Referring to both FIGS. 7 and 8, the thermal material 704 used or the design of the transfer housing 700, 800 may be tailored such that the transfer housings 700, 800 are designed to retain heat in specific regions or sections of the mold 300 along its height. This may be accomplished by having an undulating or variable bottom end 706*b*. More particularly, the bottom end 706*b* may be designed such that it provides alternating hills and valleys (e.g., high points and low points, respectively) about the circumference of the transfer housings 700, 800. More particularly, the support structure 702 may have a first height at one angular location about the transfer housing 700, 800, but may exhibit a second height at a second angular location about the transfer housing 700, 800, where the second depth is less than the first depth. As a result, the thermal material 704 only extends to the second depth at some locations about the transfer housing 700, 800 while extending to the first greater depth at other locations about the transfer housing 700, 800. Such an insulating configuration may be desirable for producing different thermal profiles in blade and junk-slot regions of the bit, respectively, as described below.

Figure 9:
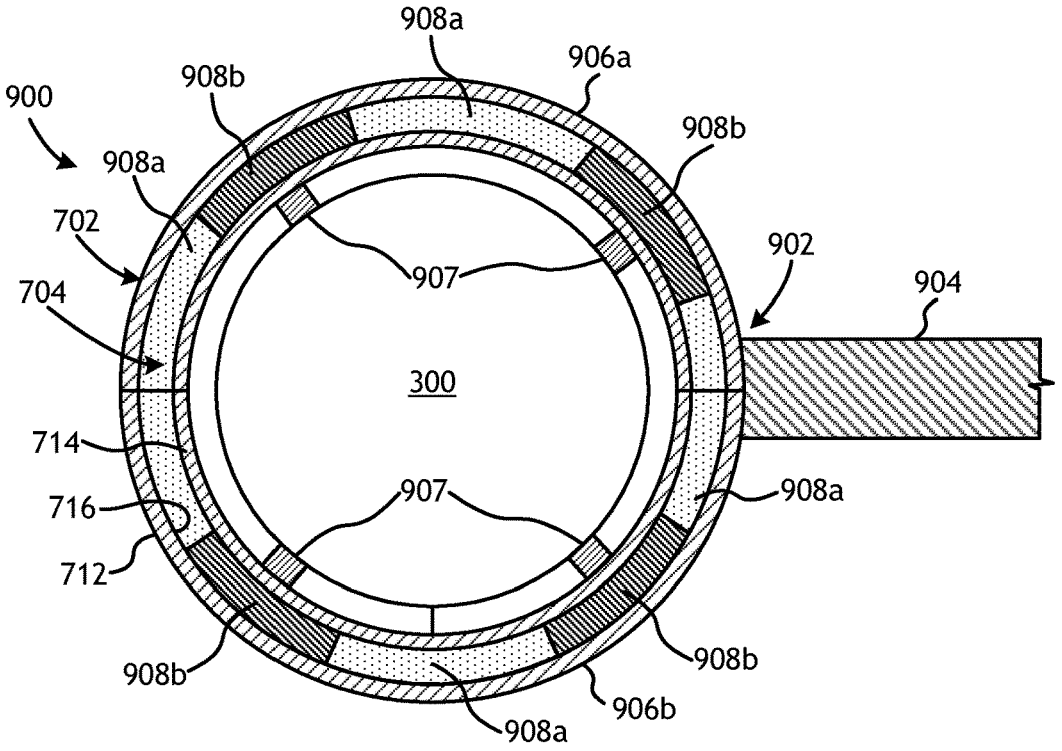
FIG. 9 is a cross-sectional top view of another exemplary transfer housing.

Referring now to FIG. 9, illustrated is a cross-sectional top view of another exemplary transfer housing 900, according to one or more embodiments. The transfer housing 900 may be representative of any of the transfer housings described herein. More specifically, regardless of the particular structural depiction shown in FIG. 9, the principles and elements discussed with respect to the transfer housing 900 may be applicable to any of the transfer housings contemplated herein, without departing from the scope of the present disclosure. Moreover, the transfer housing 900 may form part of a mold transfer assembly 902 and may, therefore, be coupled to an arm 904 that helps move the transfer housing 800 so that it can encapsulate and transfer the mold 300 from the furnace floor 304 (FIGS. 4B-4E) to the thermal heat sink 310 (FIGS. 4B-4E).

The transfer housing 900 may be similar in some respects to the transfer housing 406 of FIGS. 4B-4E and, therefore, may exhibit a clam-shell design. More particularly, the transfer housing 900 may comprise an open-ended cylinder cut into two halves, shown as a first half-cylinder 906*a* and a second half-cylinder 906*b*. The transfer housing 900 may be coupled to the arm 904 and the first and second half-cylinders 906*a,b* may be actuated between open and closed positions to receive and release the mold 300.

The transfer housing 900 may further include one or more internal features 907 (four shown) that provide an offset (radial and/or axial) between the inner surfaces of the transfer housing 900 (i.e., the first and second half-cylinders 906*a,b*) and the outer surfaces of the mold 300. In the illustrated embodiment, the internal features 907 comprise longitudinal ribs defined on the inner surfaces of the first and second half-cylinders 906*a,b* and extend along all or a portion of the height of the transfer housing 900. The internal features 907 may prevent the mold 300 from physically engaging the inner surfaces of the first and second half-cylinders 906*a,b*, and thereby substantially preventing heat loss through conduction. In other embodiments, however, the internal features 907 may alternatively comprise one or more annular rings defined on the inner surfaces of the first and second half-cylinders 906*a,b* and axially spaced from each other along a height of the transfer housing 900.

The transfer housing 900 may also be similar in some respects to the transfer housings 700 and 800 of FIGS. 7 and 8, respectively, and therefore may be best understood with reference thereto, where like numerals represent like components not described again. For instance, as illustrated, the transfer housing 900 may include the support structure 702, including the outer and inner frames 712, 714, and the thermal material 704 positioned within the cavity 716 and otherwise supported by the support structure 702. Unlike the transfer housings 700 and 800 of FIGS. 7 and 8, however, the thermal properties of the transfer housing 900 may vary about a circumference of the transfer housing 900 (e.g., the support structure 702).

Varying the thermal properties of the transfer housing 900 about its circumference may affect different geometries or structures in the metal matrix composite tool or device being formed within the mold 300. For instance, it may prove useful to vary thermal properties of the transfer housing 900 that may be placed radially or angularly adjacent portions of the mold 300 where cutter blades 102 (FIG. 1) of a drill bit 100 (FIG. 1) are being formed, as opposed to portions of the mold 300 containing junk slots 124 (FIG. 1). More particularly, it may prove advantageous to cool portions of the mold 300 where the cutter blades 102 are being formed slower than portions of the mold 300 containing the junk slots 124 so that any potential defects (e.g., voids) in the cutter blades 102 may be more effectively pushed or otherwise urged toward the top regions of the mold 300 where they can be machined off later during finishing operations.

In the illustrated embodiment, one or more arcuate portions of a first insulation material 908*a* and one or more arcuate portions of a second insulation material 908*b* may be arranged within the cavity 716. The first and second insulation materials 908*a,b* may be made of any of the materials listed above with respect to the thermal material 704. The first insulation material 908*a*, however, may exhibit one or more first thermal properties and the second insulation material 908*b* may exhibit one or more second thermal properties. In some embodiments, for instance, the first insulation material 908*a* may exhibit an R-value "$R_1$" and the second insulation material 908*b* may exhibit an R-value "$R_2$," where $R_1>R_2$. In other embodiments, the first insulation material 908*a* may exhibit a thermal conductivity "$k_1$" and the second insulation material 908*b* may exhibit a thermal conductivity "$k_2$," where $k_1<k_2$. Accordingly, it may prove advantageous to radially and/or angularly align the arcuate portions of the first insulation material 908*a* with portions of the mold 300 that are preferred to cool more slowly than angularly adjacent portions where the arcuate portions of the second insulation material 908*b* are angularly aligned with.

It will be appreciated that the thermal properties of the transfer housing 900 may also be varied about its circumference by varying the thermal conductivity of the support structure 702 over corresponding arcuate portions or segments, without departing from the scope of the disclosure. Moreover, it will further be appreciated that the embodiments disclosed in all of FIGS. 7-9 may be combined in any combination, in keeping within the scope of the disclosure. For example, the thermal properties of the transfer housing 900 may be varied about its circumference and in the longitudinal direction A simultaneously. Such an example design might include circumferential insulation material 908*a,b* in insulation zone 720*d* with thermal material 704 in insulation zones 720*a-c*. In such an embodiment, the thermal material 704 might be the same as the insulation material 908*a* and the geometry of insulation material 908*b* might correspond to the junk slots 124 of a drill bit (e.g., the drill bit 100 of FIG. 1). Many other such configurations are possible without departing from the scope of the disclosure.

Figure 10:
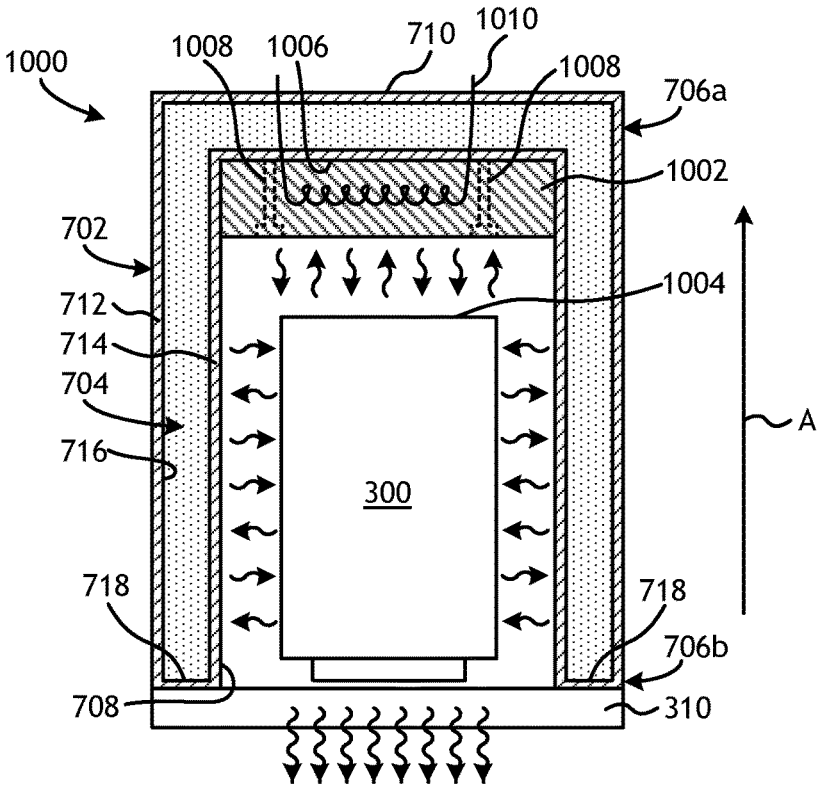
FIG. 10 is a cross-sectional side view of another exemplary transfer housing.

Referring now to FIG. 10, illustrated is a cross-sectional side view of another exemplary transfer housing 1000, according to one or more embodiments. The transfer housing 1000 may be representative of any of the transfer housings described herein. More specifically, regardless of the particular structural depiction shown in FIG. 10, the principles and elements discussed with respect to the transfer housing 1000 may be applicable to any of the transfer housings contemplated herein, without departing from the scope of the present disclosure. Moreover, the transfer housing 1000 may form part of a mold transfer assembly and, while not illustrated, the transfer housing 1000 may be coupled to an arm that also forms part of the mold transfer assembly and helps move the transfer housing 1000 so that it can encapsulate and transfer the mold 300 from the furnace floor 304 (FIGS. 4B-4E) to the thermal heat sink 310.

The transfer housing 1000 may be similar in some respects to the transfer housings 700 and 800 of FIGS. 7 and 8, respectively, and therefore may be best understood with reference thereto, where like numerals represent like components not described again. Unlike the transfer housings 700 and 800, however, the transfer housing 1000 may include a thermal mass 1002 arranged at or near the top end 706*a* of the transfer housing 1000 (i.e., the support structure 702). The thermal mass 1002 may be useful in resisting heat flow from a top 1004 of the mold 300 during cooling. More particularly, the thermal mass 1002 may help slow the cooling process of the top 1004 of the mold 300 in the axial direction A and subsequently through the top end 706*a* of the transfer housing 1000. Accordingly, arranging the thermal mass 1002 "at or near" the top end 706*a* of the transfer housing 1000 may allow the thermal mass 1002 to thermally communicate with the top 1004 of the mold 300.

The thermal mass 1002 may be coupled to or arranged on the transfer housing 1000 at various locations at or near the top end 706*a* of the support structure 702. In the illustrated embodiment, for instance, the thermal mass 1002 is depicted as being positioned within the interior 708 of the transfer housing 1000 (i.e., the support structure 702) and otherwise secured to an inner surface 1006 of the support structure 702. In other embodiments, however, the thermal mass 1002 may alternatively be positioned between the outer and inner frames 712, 714 at the top end 706*a* of the support structure 702. In yet other embodiments, the thermal mass 1002 may be arranged on the exterior of the transfer housing 1000, such as on an exterior surface of the outer frame 712 (or an exterior surface of the inner frame 714 in the event the outer frame 712 is omitted), without departing from the scope of the disclosure.

In the illustrated embodiment, the thermal mass 1002 may be secured to the inner surface 1006 of the support structure 702 using one or more mechanical fasteners 1008 (two shown), such as bolts, screws, pins, etc. In other embodiments, however, or in addition thereto, the thermal mass 1002 may be permanently attached to the inner surface 1006 of the support structure 702 by attachment processes such as welding, brazing, diffusion bonding or using an adhesive.

As used herein, the inner surface 1006 of the support structure 702 may refer to an inner surface of the inner frame 714, as illustrated, but may equally refer to the inner surface of the outer frame 712 in the event the inner frame 714 is omitted. Moreover, the inner surface 1006 of the support structure 702 may also refer to horizontal as well as vertical inner surfaces of either the outer or inner frames 712, 714, without departing from the scope of the disclosure. For instance, while the thermal mass 1002 is depicted in FIG. 10 as being mechanically fastened to a horizontal inner surface 1006 of the support structure 702 with the mechanical fasteners 1008, the thermal mass 1002 may equally be mechanically fastened to a vertical or sidewall inner surface 1006, or a combination of both.

In some embodiments, the thermal mass 1002 may be characterized as a "passive thermal mass" configured to impart thermal energy to the mold 300 to alter its thermal profile. As a result, the thermal mass 1002 may help maintain high temperatures at the top 1004 of the mold 300 while the bottom of the mold 300 is cooled. To be used as a "passive" thermal mass, the thermal mass 1002 may be preheated prior to use such that it may serve as a thermal reservoir for the mold 300 and may otherwise slow the radiative heat flux from the top 1004 of the mold 300. Suitable materials for the thermal mass 1002 include, but are not limited to, a ceramic (e.g., oxides, carbides, borides, nitrides, silicides), a metal (e.g., steel, stainless steel, nickel, tungsten, titanium or alloys thereof), fireclay, firebrick, stone, graphite, and any combination thereof. Alternatively, the thermal mass 1002 may comprise a multi-component mass or otherwise consist of several pieces or fragments of a material and, in some embodiments, may be contained or otherwise retained within a suitable vessel or container. In such embodiments, the thermal mass 1002 may include blocks, fibers, fabrics, wools, beads, particulates, flakes, sheets, bricks, a moldable ceramic, woven ceramics, cast ceramics, metal foams, metal castings, sprayed insulation, any composite thereof, and any combination thereof.

In some embodiments, the thermal mass 1002 may comprise a phase-changing material contained or otherwise retained within a suitable vessel or container. The phase-changing material may be capable of passing through a phase change, such as from a solid state to a liquid or molten state. In such embodiments, the thermal mass 1002 may be configured to pass through solid/liquid phases at a specific temperature or at a predetermined time. Suitable phase-changing materials for the thermal mass 1002 include, but are not limited to, metals, salts, and exothermic powders. Suitable metals for the phase change thermal mass may include a metal such as, but not limited to, copper, nickel, manganese, lead, tin, cobalt, silver, phosphorous, zinc, any alloys thereof, and any mixtures of the metallic alloys. Suitable exothermic powders for the phase-changing material may include a hot topping compound, such as FEEDOL●, which is commonly used in foundries.

In some embodiments, the thermal mass 1002 may be characterized as an "active thermal mass" configured to actively provide a source of the heat to the top 1004 of the mold 300. More particularly, the thermal mass 1002 may include or otherwise comprise one or more thermal elements 1010 (one shown) in thermal communication with the top 1004 of the mold 300. The thermal element(s) 1010 may be similar to the thermal elements 802*a-d* of FIG. 8 and, therefore, suitable thermal elements 1010 may be the same as listed herein above with respect to FIG. 8.

The thermal element 1010 may be in thermal communication with the top 1004 of the mold 300 via a variety of configurations. In the illustrated embodiment, for instance, the thermal element 1010 is depicted as being embedded within the thermal mass 1002. In other embodiments, however, the material for the thermal mass 1002 may be omitted and the thermal element 1010 may alternatively extend alone into the interior 708 of the transfer housing 1000. In yet other embodiments, the thermal element 1010 may be arranged between the outer and inner frames 712, 714 at the top end 706*a* of the support structure 702 or on the exterior of the transfer housing 1000, such as on an exterior surface of the outer frame 712 (or an exterior surface of the inner frame 714 in the event the outer frame 712 is omitted). The thermal element 1010 may be useful in helping to facilitate the directional solidification of the molten contents of the mold 300 as it provides thermal energy to the top 1004 of the mold 300, while the thermal heat sink 310 draws thermal energy out the bottom of the mold 300.

In some embodiments, one or more additional thermal elements (not shown) may be placed along the sides of the transfer housing 1000 to help facilitate directional cooling of the mold 300. For example, such thermal elements could be placed along the top third of the sidewalls of the transfer housing 1000 and otherwise adjacent the thermal mass 1002 and the top 1004 of the mold 300.

In some embodiments, the thermal mass 1002 may comprise a gas sealed within a vessel or container (not shown) and used to slow the cooling process of the mold 300 in the axial direction A. For example, in at least one embodiment, the gas may be configured to act as an insulator for the transfer housing 1000. Suitable gases that may be sealed within the vessel include, but are not limited to, air, argon, neon, helium, krypton, xenon, oxygen, carbon dioxide, methane, nitric oxide, nitrogen, nitrous oxide, trichlorofluoromethane (R-11), dichlorodifluoromethane (R-12), dichlorofluoromethane (R-21), difluoromonochloromethane (R-22), sulpher hexafluoride, or any combination thereof. Moreover, in some embodiments, the vessel may include at least one connection to an exterior reservoir or source configured to heat the gas and thereby allow the thermal mass 1002 to act as a heating thermal mass. In this manner, the heated gas may be used to fill the vessel once, or the heated gas may continuously cycle gas through the vessel to provide a suitable thermal reservoir. In other embodiments, the gas may be omitted from the vessel and a vacuum may alternatively be formed within the vessel.

It will be appreciated that the various embodiments described and illustrated herein may be combined in any combination, in keeping within the scope of this disclosure. Indeed, variations and combinations of any of the features described herein with reference to any of the presently disclosed transfer housings may be implemented in any of the embodiments and in any combination, without departing from the scope of the disclosure.

Embodiments disclosed herein include:

A. A mold transfer assembly that includes a transfer housing providing an interior defined by one or more sidewalls and a top, the transfer housing being sized to receive and encapsulate a mold as the mold is moved between a furnace and a thermal heat sink, and an arm coupled to the transfer housing to move the transfer housing and the mold encapsulated within the transfer housing between the furnace and a thermal heat sink, wherein the transfer housing exhibits one or more thermal properties to control a thermal profile of the mold.

B. A method that includes exposing a mold in a furnace, extending a mold transfer assembly toward the mold, the mold transfer assembly including a transfer housing and an arm coupled to the transfer housing, wherein the transfer housing is sized to receive the mold and provides an interior defined by one or more sidewalls and a top, encapsulating the mold within the interior of the transfer housing, moving the mold encapsulated within the transfer housing from the furnace to a thermal heat sink with the mold transfer assembly, and controlling a thermal profile of the mold with one or more thermal properties of the transfer housing.

Each of embodiments A and B may have one or more of the following additional elements in any combination: Element 1: further comprising an insulation enclosure sized to receive the mold. Element 2: wherein the insulation enclosure is further sized to receive the mold while encapsulated by the transfer housing. Element 3: wherein the transfer housing comprises a clam-shell design having two or more members actuatable between an open position to receive the mold and a closed position to encapsulate the mold. Element 4: further comprising one or more internal features defined on one or more inner surfaces of the transfer housing to maintain the mold at least one of radially and axially offset from the transfer housing. Element 5: wherein the transfer housing comprises a first cylinder defining a first opening sized to receive the mold, and a second cylinder concentric with the first cylinder and defining a second opening sized to receive the mold, wherein at least one of the first and second cylinders is movable with respect to the other to transition the transfer housing between an open configuration, where the mold is able to be received into the first and second cylinders via the first and second openings, and a closed configuration, where the mold is encapsulated within the first and second cylinders. Element 6: wherein the transfer housing comprises a first cylinder coupled to the arm and defining a first opening sized to receive the mold, and a second cylinder defining a second opening sized to receive the mold, wherein the mold is encapsulated by the transfer housing by being received by the first cylinder via the first opening and moved toward the second cylinder with the arm to be received by the second cylinder via the second opening. Element 7: wherein the transfer housing comprises a central cap, and a plurality of nested cylinders concentrically-arranged about the central cap and cooperatively extendable along all or a portion of a height of the mold to thereby encapsulate the mold, wherein each nested cylinder includes a complimentary interlocking shoulder that receives a corresponding interlocking shoulder of a radially-adjacent nested cylinder upon extending along the height of the mold. Element 8: wherein the one or more thermal properties vary along a height of the transfer housing. Element 9: wherein the one or more thermal properties vary about a circumference of the transfer housing. Element 10: wherein the transfer housing comprises a support structure that provides the one or more sidewalls and the top, and a thermal material coupled to or supported by the support structure, wherein the thermal material exhibits the one or more thermal properties that control the thermal profile of the mold. Element 11: wherein the thermal material is an insulation material selected from the group consisting of a ceramic, ceramic fibers, a ceramic fabric, a ceramic wool, ceramic beads, ceramic blocks, a moldable ceramic, a woven ceramic, a cast ceramic, fire bricks, carbon fibers, graphite, graphite blocks, a shaped graphite block, a nanocomposite, a fluid in a jacket, a metal, a metal fabric, a metal foam, a metal wool, a metal casting, any composite thereof, and any combination thereof. Element 12: wherein the support structure comprises an outer frame, an inner frame, and a cavity defined between the outer and inner frames, and wherein the thermal material comprises a fluid or vacuum sealed within the cavity. Element 13: wherein the thermal material operates as a thermal reservoir or thermal mass and comprises a material selected from the group consisting of a metal, a salt, a ceramic, fireclay, fire brick, stone, graphite, a phase-changing material, a fluid sealed within a vessel, and any combination thereof. Element 14: wherein the support structure comprises at least one of an outer frame and an inner frame, and wherein a reflective coating is applied to a surface of at least one of the outer and inner frames. Element 15: wherein the support structure comprises at least one of an outer frame and an inner frame, and wherein a thermal barrier is applied to a surface of at least one of the outer and inner frames. Element 16: wherein the transfer housing comprises a radiant barrier made of a material selected from the group consisting of aluminum oxide, aluminum nitride, silicon carbide, silicon nitride, quartz, titanium carbide, titanium nitride, a boride, carbides, a nitride, an oxide, iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, any alloy based thereon, and any combination thereof. Element 17: further comprising one or more thermal elements coupled to or supported by the transfer housing to selectively and actively heat the mold, the one or more thermal elements being selected from the group consisting of a heating element, a heat exchanger, a radiant heater, an electric heater, an infrared heater, an induction heater, one or more induction coils, a heating band, one or more heated coils, a heated cartridge, resistive heating elements, a refractory and conductive metal coil, strip, or bar, a microwave emitter, a tuned microwave receptive material, or any combination thereof. Element 18: further comprising one or more thermal conduits coupled to or supported by the transfer housing to circulate a thermal fluid and thereby selectively and actively heat the mold, wherein the thermal fluid is selected from the group consisting of a gas, water, steam, an oil, a coolant, a molten metal, a molten metal alloy, a fluidized bed, a molten salt, a fluidic exothermic reaction, or any combination thereof.

Element 19: further comprising releasing the mold from the transfer housing, retracting the mold transfer assembly from the mold, and lowering an insulation enclosure over the mold. Element 20: further comprising detaching the arm from the transfer housing, and retracting the arm from the transfer housing. Element 21: further comprising lowering an insulation enclosure over the transfer housing and the mold encapsulated within the transfer housing. Element 22: further comprising varying the one or more thermal properties of the transfer housing along at least one of a height of the transfer housing and a circumference of the transfer housing. Element 23: wherein the transfer housing comprises a clam-shell design having two or more members, and wherein encapsulating the mold within the interior of the transfer housing comprises actuating the two or more members to an open position to receive the mold, receiving the mold within the interior of the transfer housing, and actuating the two or more members to a closed position to encapsulate the mold. Element 24: further comprising maintaining the mold at least one of radially and axially offset from the transfer housing with one or more internal features defined on one or more inner surfaces of the transfer housing. Element 25: wherein the transfer housing comprises a first cylinder defining a first opening sized to receive the mold, and a second cylinder concentric with the first cylinder and defining a second opening sized to receive the mold, and wherein encapsulating the mold within the interior of the transfer housing comprises moving at least one of the first and second cylinders with respect to the other to transition the transfer housing to an open configuration, where the mold is able to be received into the first and second cylinders via the first and second openings, receiving the mold within the interior of the transfer housing, and moving at least one of the first and second cylinders with respect to the other to transition the transfer housing to a closed configuration, where the mold is encapsulated within the first and second cylinders. Element 26: wherein the transfer housing comprises a first cylinder coupled to the arm and defining a first opening sized to receive the mold and a second cylinder defining a second opening sized to receive the mold, and wherein encapsulating the mold within the interior of the transfer housing comprises receiving the mold in the first cylinder via the first opening, moving the first cylinder and the mold toward the second cylinder with the arm, and receiving the mold in the second cylinder via the second opening. Element 27: further comprising one or more thermal elements coupled to or supported by the transfer housing, and wherein controlling the thermal profile of the mold comprises selectively heating the mold with the one or more thermal elements. Element 28: further comprising one or more thermal conduits coupled to or supported by the transfer housing, and wherein controlling the thermal profile of the mold comprises circulating a thermal fluid through the one or more thermal conduits, and actively heating the mold with the thermal fluid.

By way of non-limiting example, exemplary combinations applicable to A, B, and C include: Element 1 with Element 2: Element 10 with Element 11; Element 10 with Element 12; Element 10 with Element 13; Element 10 with Element 14; Element 10 with Element 15; and Element 23 with Element 24.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A mold transfer assembly, comprising:

a transfer housing providing an interior defined by one or more sidewalls and a top, the transfer housing being sized to receive and encapsulate a mold as the mold is moved between a furnace and a thermal heat sink, the transfer housing comprising:

a first cylinder defining a first lateral opening sized to receive the mold; and a second cylinder concentric with the first cylinder and defining a second lateral opening sized to receive the mold, wherein at least one of the first or second cylinders is rotatable with respect to the other; and an arm coupled to the transfer housing to move the transfer housing and the mold encapsulated within the transfer housing between the furnace and a thermal heat sink, wherein the transfer housing exhibits one or more thermal properties to control a thermal profile of the mold.

2. The mold transfer assembly of claim 1, further comprising an insulation enclosure sized to receive the mold.

3. The mold transfer assembly of claim 2, wherein the insulation enclosure is further sized to receive the mold while encapsulated by the transfer housing.

4. The mold transfer assembly of claim 1, further comprising one or more internal features defined on one or more inner surfaces of the transfer housing to maintain the mold at least one of radially and axially offset from the transfer housing.

5. The mold transfer assembly of claim 1, wherein at least one of the first or second cylinders is rotatable with respect to the other to transition the transfer housing between an open configuration, where the first and second openings are aligned with one another and the mold is able to be received into the first and second cylinders via the first and second openings, and a closed configuration, where the first and second openings are offset from one another and the mold is encapsulated within the first and second cylinders.

6. The mold transfer assembly of claim 1, wherein the one or more thermal transfer properties vary along a height of the transfer housing.

7. The mold transfer assembly of claim 1, wherein the one or more thermal properties vary about a circumference of the transfer housing.

8. A method, comprising:

exposing a mold in a furnace;

extending a mold transfer assembly toward the mold, the mold transfer assembly including a transfer housing and an arm coupled to the transfer housing, wherein the transfer housing is sized to receive the mold and provides an interior defined by one or more sidewalls and a top, the transfer housing further comprising a first cylinder defining a first lateral opening sized to receive the mold, and a second cylinder concentric with the first cylinder and defining a second lateral opening sized to receive the mold, wherein at least one of the first or second cylinders is rotatable with respect to the other;

encapsulating the mold within the interior of the transfer housing;

moving the mold encapsulated within the transfer housing from the furnace to a thermal heat sink with the mold transfer assembly; and controlling a thermal profile of the mold with one or more thermal properties of the transfer housing.

9. The method of claim 8, further comprising:

releasing the mold from the transfer housing;

retracting the mold transfer assembly from the mold; and lowering an insulation enclosure over the mold.

10. The method of claim 8, further comprising:

detaching the arm from the transfer housing; and retracting the arm from the transfer housing.

11. The method of claim 8, further comprising lowering an insulation enclosure over the transfer housing and the mold encapsulated within the transfer housing.

12. The method of claim 8, further comprising varying the one or more thermal properties of the transfer housing along at least one of a height of the transfer housing and a circumference of the transfer housing.

13. The method of claim 8, further comprising maintaining the mold at least one of radially and axially offset from the transfer housing with one or more internal features defined on one or more inner surfaces of the transfer housing.

14. The method of claim 8, wherein encapsulating the mold within the interior of the transfer housing comprises:

moving at least one of the first and second cylinders with respect to the other to transition the transfer housing to an open configuration, where the mold is able to be received into the first and second cylinders via the first and second openings;

receiving the mold within the interior of the transfer housing; and moving at least one of the first and second cylinders with respect to the other to transition the transfer housing to a closed configuration, where the mold is encapsulated within the first and second cylinders.

15. The method of claim 8, further comprising one or more thermal elements coupled to or supported by the transfer housing, and wherein controlling the thermal profile of the mold comprises selectively heating the mold with the one or more thermal elements.

16. The method of claim 8, further comprising one or more thermal conduits coupled to or supported by the transfer housing, and wherein controlling the thermal profile of the mold comprises:

circulating a thermal fluid through the one or more thermal conduits; and actively heating the mold with the thermal fluid.

* * * * *